US012304607B1

(12) United States Patent
Alby et al.

(10) Patent No.: US 12,304,607 B1
(45) **Date of Patent: *May 20, 2025**

(54) MARINE DRIVES HAVING STEERABLE GEARCASE

(71) Applicant: Brunswick Corporation, Mettawa, IL (US)

(72) Inventors: Jeremy L. Alby, Oshkosh, WI (US); Darin C. Uppgard, Oshkosh, WI (US); Wayne M. Jaszewski, West Bend, WI (US); Kerry J. Treinen, Malone, WI (US); Randall J. Poirier, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 556 days.

This patent is subject to a terminal disclaimer.

(21) Appl. No.: 17/563,484

(22) Filed: Dec. 28, 2021

Related U.S. Application Data

(63) Continuation-in-part of application No. 17/461,317, filed on Aug. 30, 2021, now Pat. No. 11,661,163,
(Continued)

(51) Int. Cl.
*B63H 20/16* (2006.01)
*B63H 20/12* (2006.01)
(Continued)

(52) U.S. Cl.
CPC ..... *B63H 20/16* (2013.01); *B63H 20/12* (2013.01); *B63H 20/245* (2013.01); *B63H 20/28* (2013.01);
(Continued)

(58) Field of Classification Search
CPC ..... B63H 20/08; B63H 20/12; B63H 20/16; B63H 20/24; B63H 20/245; B63H 20/28;
(Continued)

(56) References Cited

U.S. PATENT DOCUMENTS 1,161,935 A 11/1915 Heck
1,774,956 A 9/1930 Wilson
(Continued)

FOREIGN PATENT DOCUMENTS

CA 1317165 5/1993
CN 101475050 7/2009
(Continued)

OTHER PUBLICATIONS

Murray, Charles J., Boat drive Increases Usable Onboard Space: Outboard Motor is Mounted Inboard, Reprinted from Design News, Mar. 1989, United States.
(Continued)

*Primary Examiner* — Daniel V Venne
(74) *Attorney, Agent, or Firm* — Andrus Intellectual Property Law, LLP

(57) ABSTRACT

A marine drive comprising a powerhead that causes rotation of a driveshaft, a gearcase that supports a propulsor for propelling the marine drive in a body of water, a steering housing disposed between the powerhead and the gearcase, wherein the driveshaft or an extension thereof extends through the steering housing is operatively coupled to the propulsor, and a steering mechanism configured to steer the gearcase about a steering axis relative to the steering housing. The gearcase and steering housing are connected at a steering joint through which at least one of cooling water from the body of water is conveyed to the powerhead throughout steering movement of the gearcase and exhaust from the powerhead is conveyed to the body of water throughout steering movement of the gearcase.

20 Claims, 23 Drawing Sheets

Related U.S. Application Data which is a continuation of application No. 16/796,388, filed on Feb. 20, 2020, now Pat. No. 11,130,554, which is a continuation of application No. 16/171,490, filed on Oct. 26, 2018, now Pat. No. 10,800,502.

(51) Int. Cl.

| | |
|---|---|
| ***B63H 20/24*** | (2006.01) |
| ***B63H 20/28*** | (2006.01) |
| ***F01N 13/00*** | (2010.01) |
| ***F01P 3/20*** | (2006.01) |
| ***F01P 11/04*** | (2006.01) |

(52) U.S. Cl.

CPC ..... *F01N 13/001* (2013.01); *F01N 13/004* (2013.01); *F01P 3/202* (2013.01); *F01P 11/04* (2013.01); *F01P 2050/12* (2013.01)

(58) Field of Classification Search

CPC ..... B63H 20/34; B63H 2020/08; F01P 3/202; F01P 11/04; F01P 2050/12; F01N 13/001; F01N 13/004

USPC ... 440/53, 61 S, 76, 88 R, 88 C, 88 D, 88 G, 440/88 J, 88 K, 89 R, 89 B, 89 C, 89 D

See application file for complete search history.

(56) References Cited

U.S. PATENT DOCUMENTS

| | | | | |
|---|---|---|---|---|
| 2,372,247 | A | 3/1945 | Pemberton | |
| 2,384,436 | A | 9/1945 | Bossen | |
| 2,536,894 | A | 1/1951 | Wanzer | |
| 2,549,481 | A | 4/1951 | Kiekhaefer | |
| 2,688,299 | A | 9/1954 | Gload et al. | |
| 2,804,838 | A | 9/1957 | Moser | |
| 2,732,819 | A | 3/1959 | Harris | |
| 2,877,733 | A | 3/1959 | Harris | |
| 2,902,967 | A | 9/1959 | Wanzer | |
| 3,021,725 | A | 2/1962 | Schneider | |
| 3,084,657 | A | 4/1963 | Kiekhaefer | |
| 3,094,967 | A | 6/1963 | Willis | |
| 3,164,122 | A | 1/1965 | Morris | |
| 3,171,382 | A | 3/1965 | Bergstedt | |
| 3,285,221 | A | 11/1966 | North | |
| 3,310,021 | A | 3/1967 | Shimanckas | |
| 3,376,842 | A | 4/1968 | Wynne | |
| 3,404,586 | A | 10/1968 | Fanstone | |
| 3,483,843 | A | 12/1969 | Hawthorne | |
| 3,486,478 | A | 12/1969 | Halliday | |
| 3,548,775 | A | 12/1970 | Hammond et al. | |
| 3,707,939 | A | 1/1973 | Berg | |
| 3,738,306 | A | 6/1973 | Pinkerton | |
| 3,756,188 | A | 9/1973 | Smith | |
| 3,795,219 | A | 3/1974 | Peterson | |
| 3,841,257 | A | 10/1974 | Strang | |
| 3,881,443 | A | 5/1975 | Hamp | |
| 3,896,757 | A | 7/1975 | Kucher | |
| 3,930,436 | A | 1/1976 | Hedenberg | |
| 3,946,698 | A | 3/1976 | LaFollette et al. | |
| 4,276,034 | A | 6/1981 | Kashmerick | |
| 4,297,097 | A | 10/1981 | Kiekhaefer | |
| 4,323,354 | A | 4/1982 | Blanchard | |
| 4,343,612 | A | 8/1982 | Blanchard | |
| 4,371,348 | A | 2/1983 | Blanchard | |
| 4,418,633 | A | 12/1983 | Krautkremer et al. | |
| 4,432,737 | A | 2/1984 | Johansson | |
| 4,619,548 | A | 10/1986 | Kazaoka et al. | |
| 4,668,195 | A | 5/1987 | Smith | |
| 4,747,795 | A | 5/1988 | Kawamura et al. | |
| 4,887,982 | A | 12/1989 | Newman et al. | |
| 4,907,994 | A | 3/1990 | Jones | |
| 4,911,666 | A | 3/1990 | Gage et al. | |
| 4,932,907 | A | 6/1990 | Newman et al. | |
| 5,024,639 | A | 6/1991 | Crispo | |
| 5,108,325 | A | 4/1992 | Livingston et al. | |
| 5,112,256 | A | 5/1992 | Clement | |
| 5,224,888 | A | 7/1993 | Fujimoto et al. | |
| 5,280,708 | A | 1/1994 | Sougawa et al. | |
| 5,463,990 | A | 11/1995 | Rush, II et al. | |
| 5,465,633 | A | 11/1995 | Bernloehr | |
| 5,480,330 | A | 1/1996 | Brown | |
| 5,487,687 | A | 1/1996 | Idzikowski et al. | |
| 5,522,744 | A | 6/1996 | Schlogel | |
| 5,540,606 | A | 7/1996 | Strayhorn | |
| 5,660,571 | A | 8/1997 | Nakayasu et al. | |
| 5,674,099 | A | 10/1997 | Muramatsu et al. | |
| 5,711,742 | A | 1/1998 | Leinonen et al. | |
| 5,743,774 | A | 4/1998 | Adachi et al. | |
| 6,146,220 | A | 11/2000 | Alby et al. | |
| 6,183,321 | B1 | 2/2001 | Alby et al. | |
| 6,273,771 | B1 | 8/2001 | Buckley et al. | |
| 6,276,977 | B1 | 8/2001 | Treinen et al. | |
| 6,286,845 | B1 | 9/2001 | Lin | |
| 6,287,159 | B1 | 9/2001 | Polakowski et al. | |
| 6,346,017 | B1 * | 2/2002 | Silorey | B63H 23/08 440/86 |
| 6,402,577 | B1 | 6/2002 | Treinen et al. | |
| 6,431,928 | B1 | 8/2002 | Aarnivuo | |
| 6,497,594 | B1 * | 12/2002 | Towner | B63H 5/125 440/53 |
| 6,544,085 | B1 | 4/2003 | Menard et al. | |
| 6,554,083 | B1 | 4/2003 | Kerstetter | |
| 6,561,859 | B1 * | 5/2003 | Towner | B63H 20/04 440/61 S |
| 6,609,939 | B1 | 8/2003 | Towner et al. | |
| 7,163,427 | B1 | 1/2007 | Lee | |
| 7,244,152 | B1 | 7/2007 | Uppgard | |
| 7,267,587 | B2 | 9/2007 | Oguma et al. | |
| 7,290,638 | B2 | 11/2007 | Shiino et al. | |
| 7,347,753 | B1 | 3/2008 | Caldwell et al. | |
| 7,387,556 | B1 | 6/2008 | Davis | |
| 7,517,262 | B2 | 4/2009 | Mizutani | |
| 7,527,537 | B2 | 5/2009 | Mizutani | |
| 7,588,473 | B2 | 9/2009 | Beachy Head | |
| 7,641,527 | B1 | 1/2010 | Balaji et al. | |
| 7,662,005 | B2 | 2/2010 | Provost | |
| 7,699,674 | B1 | 4/2010 | Wald et al. | |
| 7,794,295 | B2 | 9/2010 | Beachy Head | |
| 7,871,302 | B2 | 1/2011 | Provost | |
| 7,886,678 | B2 | 2/2011 | Mizutani | |
| 7,896,304 | B1 | 3/2011 | Eichinger et al. | |
| 8,118,630 | B2 | 2/2012 | Konakawa et al. | |
| 8,118,701 | B2 | 2/2012 | Okabe et al. | |
| 8,142,247 | B2 | 3/2012 | Konakawa et al. | |
| 8,157,694 | B2 | 4/2012 | Nakamura et al. | |
| 8,246,398 | B2 | 8/2012 | Inaba | |
| 8,246,399 | B2 | 8/2012 | Inaba | |
| 8,327,789 | B2 | 12/2012 | Emch | |
| 8,425,373 | B2 | 4/2013 | Okabe et al. | |
| 8,485,854 | B2 | 7/2013 | Gallato et al. | |
| 8,651,904 | B2 | 2/2014 | Pellegrinetti et al. | |
| 8,690,616 | B2 | 4/2014 | Grassi et al. | |
| 8,715,021 | B2 | 5/2014 | Horkko et al. | |
| 8,795,011 | B2 | 8/2014 | Takase et al. | |
| 8,808,045 | B2 | 8/2014 | Lundqvist et al. | |
| 9,205,906 | B1 | 12/2015 | Eichinger | |
| 9,233,743 | B2 | 1/2016 | Daikoku et al. | |
| 9,296,458 | B2 | 3/2016 | Saruwatari et al. | |
| 9,334,034 | B1 | 5/2016 | Waldvogel et al. | |
| 9,446,828 | B1 | 9/2016 | Groeschel et al. | |
| 9,475,560 | B1 | 10/2016 | Jaszewski et al. | |
| 9,776,700 | B2 | 10/2017 | Beachy Head | |
| 9,809,289 | B2 | 11/2017 | Nutt et al. | |
| 9,849,957 | B1 | 12/2017 | Grahl et al. | |
| 9,896,175 | B2 | 2/2018 | Galleta, Jr. | |
| 10,215,278 | B1 | 2/2019 | Techscherer et al. | |
| 10,315,747 | B1 | 6/2019 | Jaszewski et al. | |
| 10,392,091 | B2 | 8/2019 | Galleta, Jr. | |
| 10,518,858 | B1 | 12/2019 | Klawitter et al. | |
| 10,752,328 | B1 | 8/2020 | Bielefeld et al. | |
| 10,800,502 | B1 | 10/2020 | Alby et al. | |
| 11,068,297 | B2 | 7/2021 | Galletta, Jr. | |
| 11,130,554 | B1 | 9/2021 | Alby et al. | |

(56) References Cited

U.S. PATENT DOCUMENTS

| | | | |
|---|---|---|---|
| 11,292,568 | B2 | 4/2022 | Galletta, Jr. |
| 2007/0004294 | A1 | 1/2007 | Mansfield et al. |
| 2013/0045648 | A1 | 2/2013 | Kinpara et al. |
| 2021/0339839 | A1 | 11/2021 | Galletta, Jr. |

FOREIGN PATENT DOCUMENTS

| | | |
|---|---|---|
| GB | 364207 | 1/1932 |
| JP | 6004958 | 10/2016 |
| WO | 2007020906 | 2/2007 |
| WO | 2017223240 | 12/2017 |

OTHER PUBLICATIONS

NTN Overview & CVJ Technology, Prepared for Mercury Marine on Aug. 7, 2018. www.ntnamericas.com.

* cited by examiner

MARINE DRIVES HAVING STEERABLE GEARCASE

CROSS REFERENCE TO RELATED APPLICATIONS

The present patent application is a continuation-in-part of U.S. patent application Ser. No. 17/461,317, filed Aug. 30, 2021, now U.S. Pat. No. 11,661,163, issued May 30, 2023, which is a continuation of U.S. application Ser. No. 16/796,388, filed Feb. 20, 2020, now U.S. Pat. No. 11,130,554, issued Sep. 28, 2021, which is a continuation of U.S. application Ser. No. 16/171,490, filed Oct. 26, 2018, now U.S. Pat. No. 10,800,502, issued Oct. 13, 2020. The above applications are hereby incorporated herein by reference in entirety.

FIELD

The present disclosure relates to marine drives for propelling a marine vessel in water.

BACKGROUND

The following U.S. Patents are incorporated herein by reference in entirety:

U.S. Pat. No. 5,224,888 discloses a boat outboard propulsion assembly having an engine mounted on an engine support which, in turn, is secured to a swivel bracket adapted to be secured to a transom of a boat. Between the engine support and the engine, a steering bracket is provided which is attached to a propulsion unit that is pivotally supported by the engine support such that steering of the boat is accomplished by pivoting of the propulsion unit while the engine remains fixedly secured relative to the swivel bracket. The output drive shaft of the engine extends through the steering bracket and is connected to the propulsion unit. Engine exhaust gases are channeled through the steering bracket and the propulsion unit.

U.S. Pat. No. 5,487,687 discloses an outboard marine drive having a midsection between the upper powerhead and the lower gear case and having a removable midsection cowl assembly including first and second cowl sections. The midsection housing includes an oil sump in one embodiment and further includes an exhaust passage partially encircled by cooling water and partially encircled by engine oil for muffling engine exhaust noise. The midsection housing also has an oil drain arrangement providing clean oil draining while the outboard drive is mounted on a boat and in the water.

U.S. Pat. No. 6,183,321 discloses an outboard motor having a pedestal that is attached to a transom of a boat, a motor support platform that is attached to the outboard motor and a steering mechanism that is attached to both the pedestal and the motor support platform. A hydraulic tilting mechanism is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

U.S. Pat. No. 6,402,577 discloses a hydraulic steering system in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allow the extension of the steering arm to move relative to a moveable second portion of the steering actuator. The moveable second portion of the steering actuator moves linearly within a cylinder cavity formed in a first portion of the steering actuator.

U.S. Pat. No. 7,244,152 discloses an adapter system provided as a transition structure which allows a relatively conventional outboard motor to be mounted to a pedestal which provides a generally stationary vertical steering axis. An intermediate member is connectable to a transom mount structure having a connector adapted for mounts with central axes generally perpendicular to a plane of symmetry of the marine vessel. Many types of outboard motors have mounts that are generally perpendicular to this configuration. The intermediate member provides a suitable transition structure which accommodates both of these configurations and allows the conventionally mounted outboard motor to be supported, steered, and tilted by a transom mount structure having the stationary vertical steering axis and pedestal-type configuration.

U.S. Pat. No. 8,246,398 discloses an outboard marine motor including an upper case enclosing an engine and a lower case fitted with a propeller and connected to a lower end of the upper case. The lower case is configured to be turned relative to the upper case around a vertical axial line. The power of the engine is transmitted to the propeller via a vertical drive shaft which is coaxial with the vertical axial line. Thereby, the outboard marine motor can be steered simply by turning the lower case.

U.S. Pat. No. 9,475,560 discloses an outboard motor having an internal combustion engine, and an adapter plate having an upper end that supports the engine and a lower end formed as a cylindrical neck. A driveshaft housing has an integral oil sump collecting oil that drains from the engine and through the adapter plate neck. One or more bearings couple the adapter plate neck to the oil sump such that the driveshaft housing is suspended from and rotatable with respect to the adapter plate. A driveshaft is coupled to a crankshaft of the engine and extends along a driveshaft axis through the adapter plate neck, bearing(s), and oil sump. A steering actuator is coupled to and rotates the oil sump, and thus the driveshaft housing, around the driveshaft axis with respect to the adapter plate, which varies a direction of the outboard motor's thrust.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

A marine drive has a powerhead that causes rotation of a driveshaft, a gearcase that supports a propulsor for propelling the marine drive in a body of water, a steering housing disposed between the powerhead and the gearcase, wherein the driveshaft or an extension thereof extends through the steering housing is operatively coupled to the propulsor, and a steering mechanism configured to steer the gearcase about a steering axis relative to the steering housing. The gearcase and steering housing are connected at a steering joint through which at least one of cooling water from the body of water is conveyed to the powerhead throughout steering movement of the gearcase and exhaust from the powerhead is conveyed to the body of water throughout steering movement of the gearcase.

In non-limiting examples, a cooling water passage is in the steering housing and an oblong, widened cooling water channel is in the gearcase, wherein the cooling water passage has an inlet end that faces and receives cooling water from the cooling water channel during steering movement of the gearcase relative to the steering housing. An exhaust passage is in the steering housing and an oblong, widened exhaust channel is in the gearcase, wherein the exhaust passage has an inlet end that faces and receives exhaust from the exhaust channel during steering movement of the gearcase relative to the steering housing.

In non-limiting examples, the steering mechanism comprises a worm drive and the steering joint comprises an annular bearing. The worm drive is coupled to the annular bearing such that operation of the worm drive in a first direction steers the gearcase in a port direction and such that operation of the worm drive in an opposite, second direction steers the gearcase in a starboard direction.

In non-limiting examples, the steering mechanism comprises a first and second linear actuators coupled to the steering housing and gearcase. Extension of the first linear actuator and retraction of the second linear steers the gearcase in the first direction. Retraction of the first linear actuator and extension of the second linear actuator steers the gearcase in the opposite, second direction.

In non-limiting examples, the steering mechanism comprises a steering column fixed to the gearcase and extending into the steering housing, and a piston that is movable back and forth in a cylinder. The piston is engaged with the steering column via yoke and trunnion such that back-and-forth movement of the piston causes rotation of the steering column and the gearcase about the steering axis. The yoke comprises a yoke body that is rotatably fixed to the steering column and a yoke arm that extends from the yoke body into engagement with the trunnion.

In non-limiting examples, the steering mechanism comprises a piston that is movable back and forth in a cylinder. The piston is engaged with the steering column via a rack and pinion such that back-and-forth movement of the piston causes rotation of the steering column and the gearcase about the steering axis.

These and other non-limiting embodiments are provided herein.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
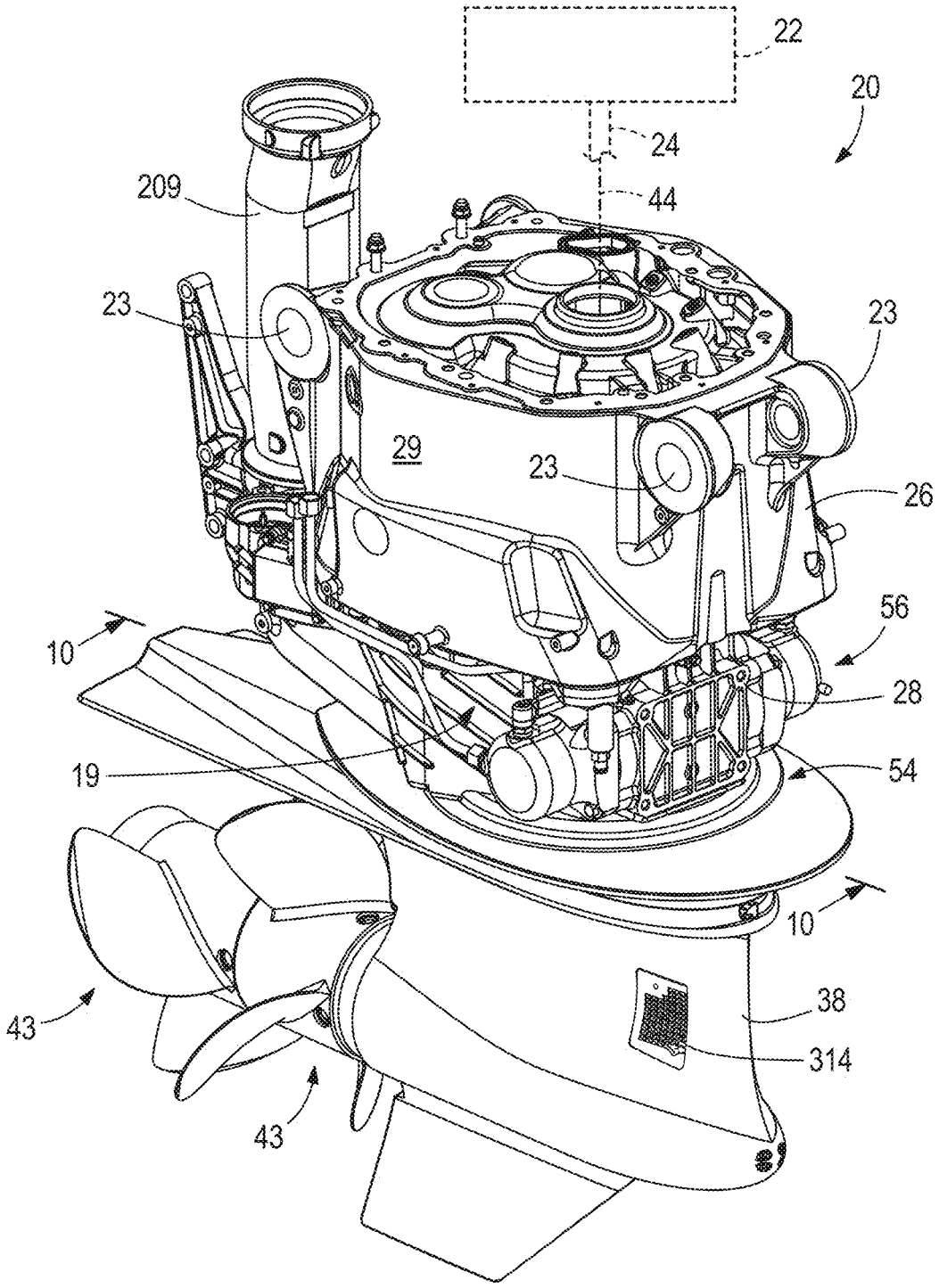
FIG. 1 is a perspective view of a driveshaft housing, steering housing and lower gearcase of an outboard motor according to a first embodiment of the present disclosure.

Conventional outboard motors typically are steerable about a steering axis with respect to a marine vessel to change the direction of thrust produced by the outboard motor and thereby vary the direction of travel. In addition, conventional outboard motors typically are tilt-able (trim-able) about a horizontal trim axis to redirect the direction of thrust upwardly or downwardly and thereby vary the attitude of the marine vessel in the water. Examples of such configurations are disclosed in the above-incorporated U.S. patents.

During research and development, the present inventors have identified that a current trend in the marketplace is to provide outboard motors having a relatively large size, particularly around the powerhead. This is to meet consumer demand for more power. This trend presents challenges for boat designers and boat owners because the available design-space for mounting outboard motors on marine vessels is relatively small. When installing new larger-sized outboard motors on a marine vessel, designers and owners often want to use existing mounting locations on the transom of the marine vessel. However, the distance between the centerlines of these mounting locations is often only about twenty-six inches, which may not provide enough room for turning, tilting, and trimming movements of larger-sized outboard motors, especially in multiple-outboard-motor configurations. When an operator of a marine vessel steers two or more adjacent larger-sized outboard motors about their steering axes, the outboard motors may collide. Such interference can also be incurred when the outboard motors are tilted or trimmed about their horizontal trim axes.

Additionally, some consumers wish to install four or more outboard motors on a marine vessel. Marine vessels are generally limited in overall width for several reasons and fitting this many outboard motors on a single transom can be difficult, especially when their respective powerheads are large. Other cases where outboard motors have the potential to interfere with one another include marine vessels having less than twenty-six-inch mounting centerlines, or in cases where V-shaped engines (especially in the two hundred-plus horsepower range) are used. V-Shaped engines are often significantly wider than inline engines. Additionally, it would be desirable to be able to mount smaller engines (such as inline six-cylinder engines) on centerlines that are less than twenty-six inches from one another.

Further, the present inventors have identified that as outboard motors are designed with larger size, the distance of the larger mass and center of gravity of the outboard motor from the transom, and more importantly from the steering axis, can have a negative effect on handling. In outboard motor configurations, the mass of the powerhead is attached to the steering rudder by which steering is controlled. Any compliance and/or unwanted motion in the steering through the steering components, structure, and isolation mounts is magnified by the attached mass.

The present inventors determined that the above-described problems could be overcome by providing outboard motor configurations wherein the powerhead remains stationary while the gearcase and associated rudder is steered. This permits less powerhead motion during steering, allows closer mounting of the outboard to the transom, and maintains a large portion of the mass separated from steering motions. This allows the steering axis to be ideally positioned with respect to the gearcase and rudder, independent of the center of gravity of the outboard motor. The present disclosure is a result of the present inventors' efforts to overcome design challenges related to these configurations.

FIGS. 1-6 and 10-14 depict a first embodiment of an outboard motor 20 having a powerhead (shown schematically at 22 in FIG. 1), which for example can include an internal combustion engine and/or any other conventional mechanism for causing rotation of an axially extending driveshaft 24. The driveshaft 24 extends into a driveshaft housing 26 located below the powerhead 22. Optionally, the driveshaft housing 26 contains a sump for containing oil or similar lubricant for the noted internal combustion engine. Optionally the driveshaft 24 is connected to a transmission for engaging forward, reverse and neutral gear positions of the outboard motor 20. Optionally, the driveshaft housing also includes mounting locations 23 for mounting the outboard motor 20 to a supporting cradle that is coupled to a transom bracket and/or the like, for supporting the outboard motor 20 with respect to the transom of a marine vessel. The type and configuration of the driveshaft housing 26 is merely exemplary and can vary from what is shown.

Figure 2:
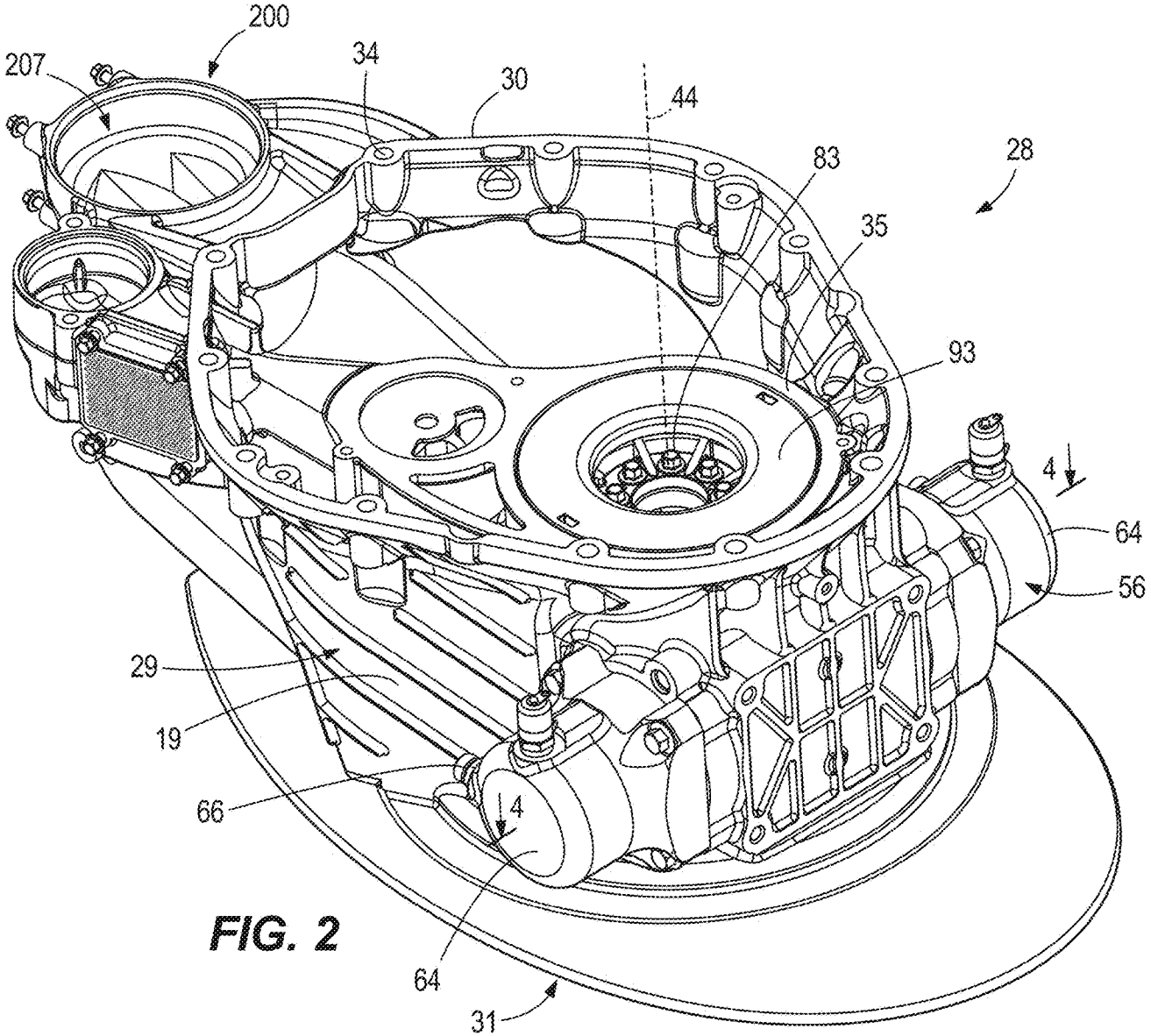
FIG. 2 is a perspective view looking down at a steering housing of the first embodiment.

Referring to FIGS. 1 and 2, a novel steering housing 28 is located below the driveshaft housing 26. The steering housing 28 is a generally oblong member having a main body 29 and upper and lower perimeter mounting flanges 30, 31 (see FIG. 2). The upper perimeter mounting flange 30 is fixed to the lower perimeter of the driveshaft housing 26 by bolts (not shown) engaged in bolt holes 34. The bolts and bolt holes 34 are spaced apart around the upper perimeter mounting flange 30, as shown, so that the steering housing 28 and driveshaft housing 26 remain securely fixed together. A center-column 35 defining a through-bore 36 (see FIG. 3) axially extends from top to bottom through the steering housing 28. The driveshaft 24, itself or via an extension member, axially-extends through the through-bore 36. In the illustrated example, the center-column 35 and through-bore 36 are generally cylindrical and contain a bearing arrangement for supporting steering of the outboard motor 20, as will be further described herein below.

Figure 10:
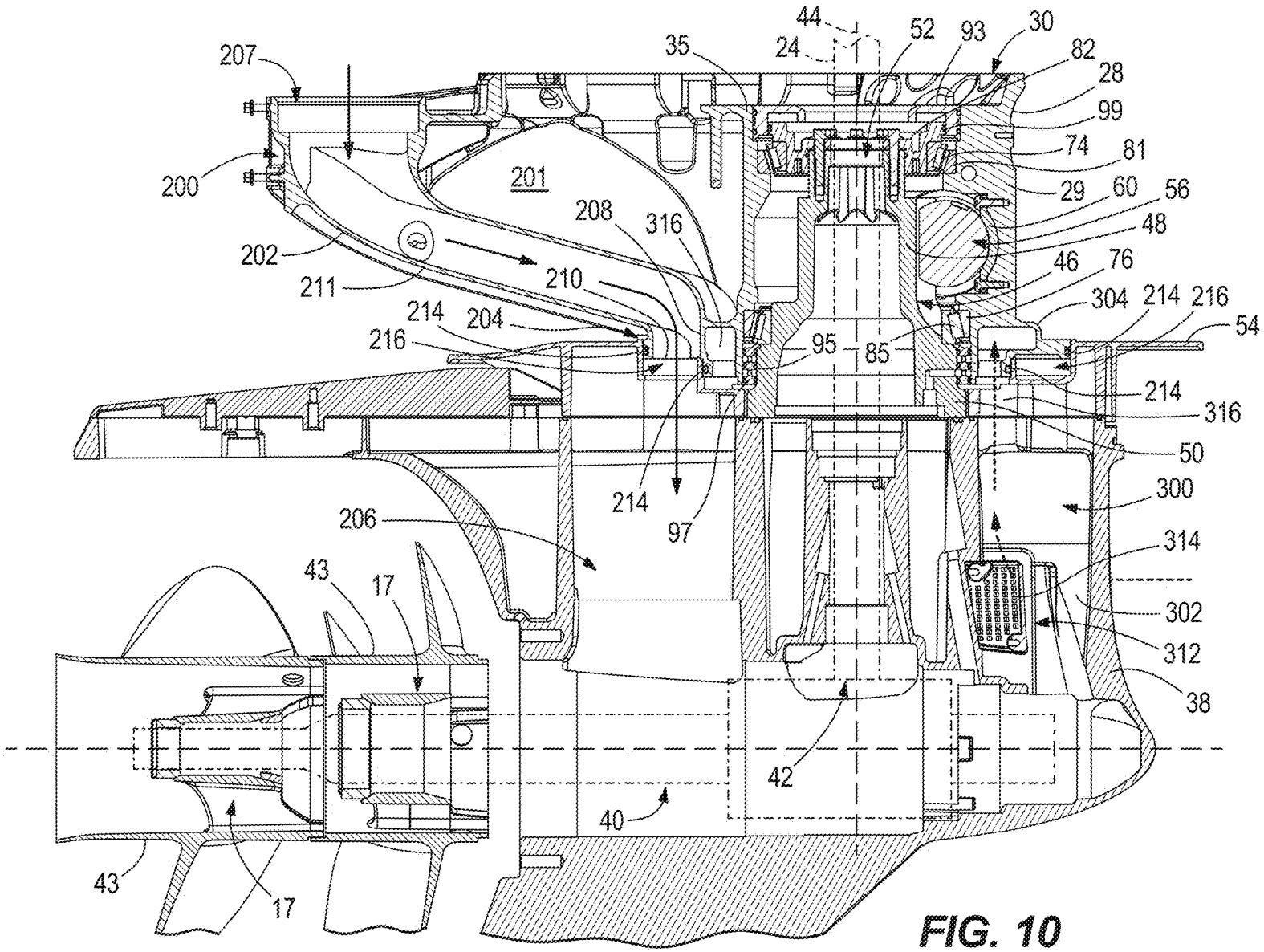
FIG. 10 is a view of section 10-10, taken in FIG. 1, showing flow of exhaust gas and cooling water through the lower gearcase and steering housing of the first embodiment.

Referring to FIGS. 1 and 10, the outboard motor 20 also has a lower gearcase 38, which is located below the steering housing 28 and supports one or more laterally extending propeller shafts (the location of which is shown via dashed lines 40 in FIG. 10). The illustrated example requires a pair of counter-rotating propeller shafts; however, arrangements with only one propeller shaft could also be employed. The propeller shafts are coupled to the driveshaft 24, for example directly thereto or via an axial extension thereof, by a conventional angled gearset (the location of which is also shown by dashed lines 42). The angled gearset is configured in the usual way so that rotation of the driveshaft 24 about its own axis causes counter rotation of the propeller shafts about their own laterally extending axes. Counter-rotating propellers 43 are mounted on the pair of propeller shafts, respectively, so that rotation of the propeller shafts 40 causes rotation of the propellers 43. Rotation of the propellers 43 generates thrust forces in water, all as conventional.

Referring to FIGS. 1, 3, 5 and 6, the lower gearcase 38 is a housing that is steerable about a steering axis 44 with respect to the steering housing 28 and powerhead 22. In the illustrated example, the steering axis 44 is coaxial with the driveshaft 24. A steering column 46 (FIG. 3) is fixed to the top of the lower gearcase 38 and extends upwardly into the bottom of the steering housing 28. The steering column 46 is an exhaust member having a center column 48 that extends upwardly from a lower perimeter mounting flange 50. A through-bore 52 extends through the center column 48 and defines an open interior in the center column 48. The driveshaft 24 extends through the open interior of the center column 48, into the lower gearcase 38, and into engagement with the noted propeller shafts via the noted angle gearset.

Figure 12:
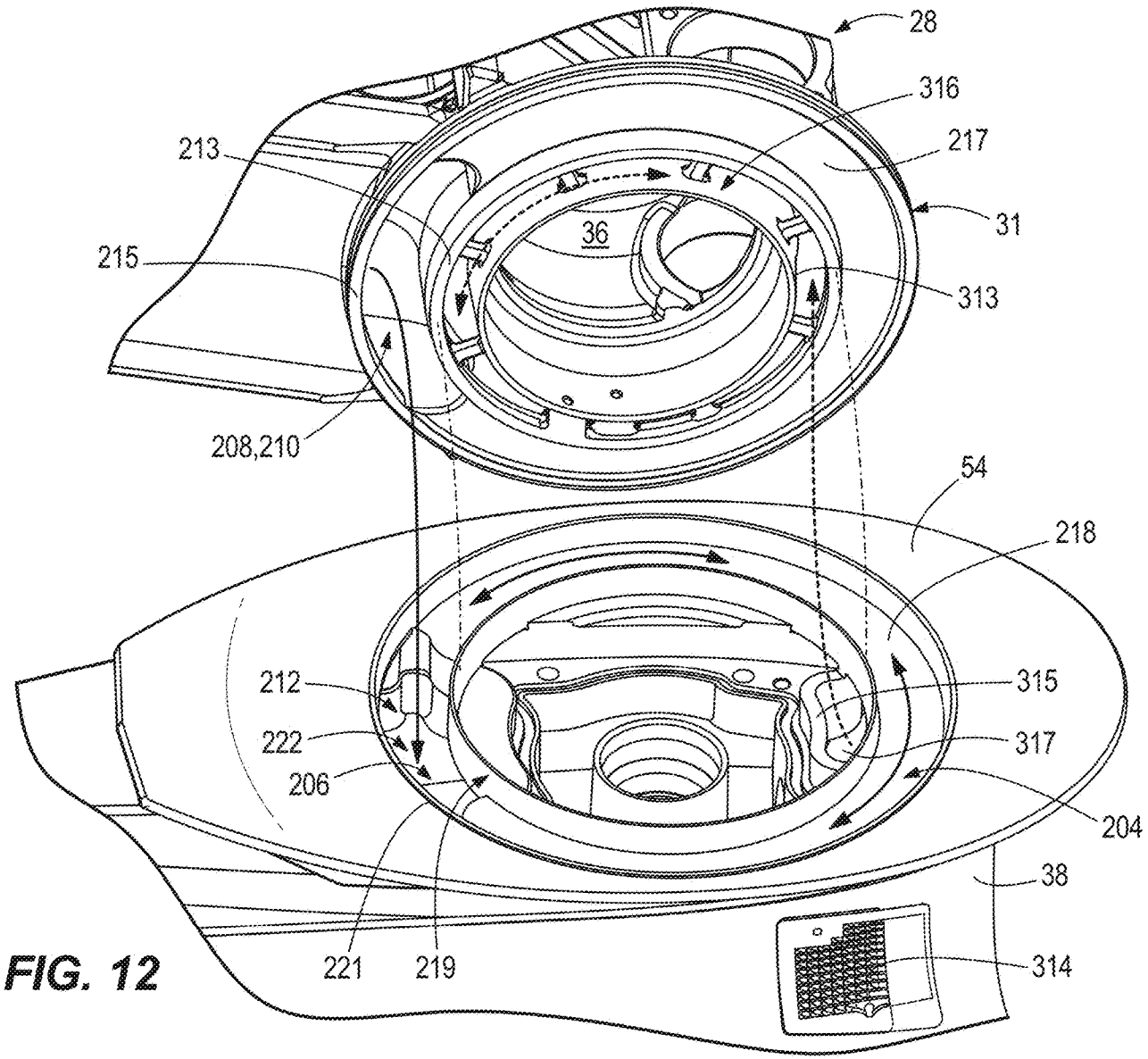
FIG. 12 is an exploded view showing a lower side of the steering housing and a top side of the lower gearcase and showing flow of the exhaust gas and cooling water from the lower gearcase to the steering housing.

Referring to FIGS. 1, 10, and 12, a gearcase cover 54 is fixed to the top of the lower gearcase 38. Optionally, the gearcase cover 54 is a plate member that is separate component from the lower gearcase 38. The lower perimeter mounting flange 50 of the steering column 46 is coupled to the gearcase cover 54 via bolts (not shown). The bolts extend through bolt holes 53 (FIG. 3) formed through the lower perimeter mounting flange 50 on the steering column 46 and through the gearcase cover 54, respectively, and fix the gearcase cover 54 with respect to the lower gearcase 38 so that the lower gearcase 38, gearcase cover 54 and steering column 46 rotate together with respect to the steering housing 28. The way the steering column 46 is fixed to the top of the lower gearcase 38 can vary from what is shown and described.

Figure 3:
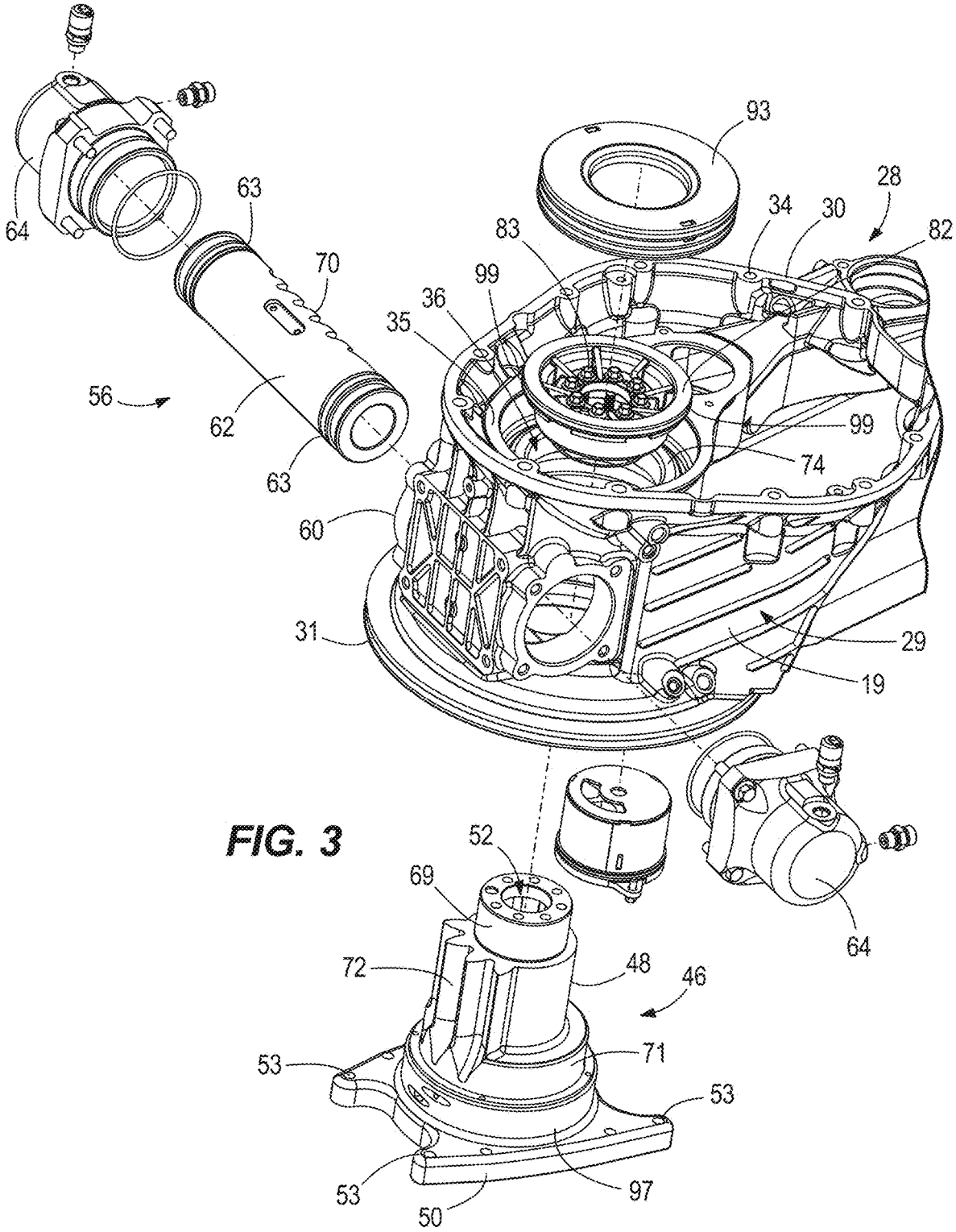
FIG. 3 is an exploded view showing the steering housing, steering actuator, and a steering column according to the first embodiment.
Figure 4:
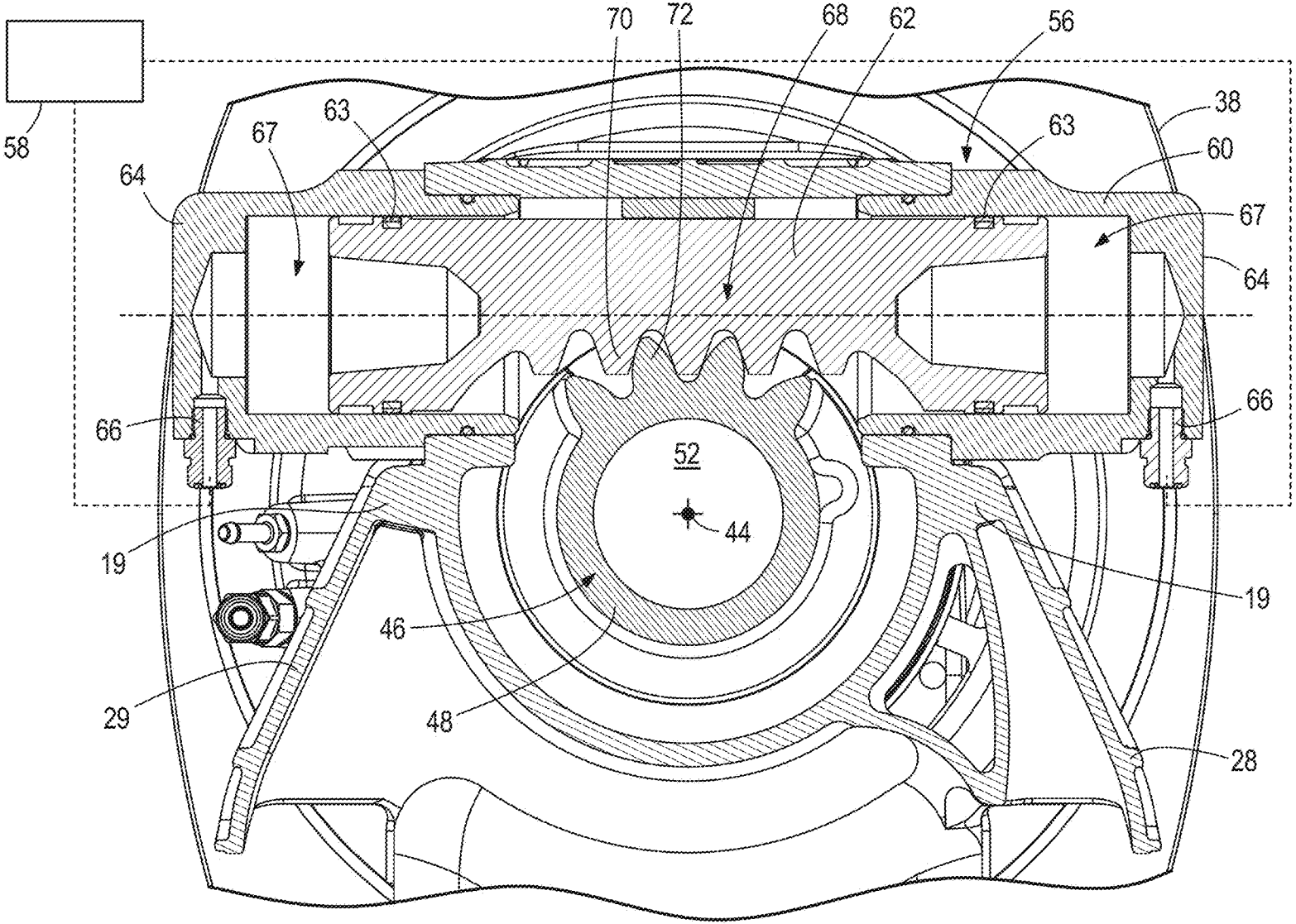
FIG. 4 is a view of section 4-4, taken in FIG. 2.

Referring to FIGS. 3 and 4, a steering actuator 56 is configured to rotate the steering column 46 together with lower gearcase 38 with respect to the steering housing 28 and powerhead 22. The type and configuration of the steering actuator 56 can vary, as will become apparent from the second embodiment described herein below with reference to FIGS. 7-9. In the example shown in FIGS. 3 and 4, the steering actuator 56 is a hydraulically actuated mechanism which is controlled by a supply of hydraulic fluid from a conventional hydraulic pump 58. The steering actuator 56 has a cylinder 60 to which the pump 58 provides a pressurized supply of hydraulic fluid. In this example, the cylinder 60 is formed in the main body 29 of the steering housing 28 and particularly through opposing sidewalls 19 on opposite sides of the steering housing 28, as shown. The steering actuator 56 further has a piston 62 that is in the cylinder 60. The piston 62 has radially outer seals 63 that seal with the radially inner sidewalls of the cylinder 60 to define opposing fluid chambers 67 in the cylinder 60. The piston 62 is movable (i.e., slide-able) back and forth in the cylinder 60 under pressure from the hydraulic fluid provided by the pump 58. End caps 64 are mounted on sidewalls 19 of the steering housing 28 contain the hydraulic fluid in the respective fluid chambers 67 of the cylinder 60. Opposing inlets 66 are formed in the cylinder 60 and couple the fluid chambers 67 to the pump 58 so that the pump 58 can supply the hydraulic fluid under pressure to opposite sides of the cylinder 60 and thereby cause the piston 62 to forcibly move back and forth in the cylinder 60.

In the example shown in FIGS. 3 and 4, the steering actuator 56 is operably coupled to the steering column 46 by a rack and pinion 68, which in this example includes sets of teeth 70, 72 on the piston 62 and the center column 48 of the steering actuator 56, respectively. The sets of teeth 70, 72 are meshed together so that back-and-forth movement of the piston 62 within the cylinder 60 causes the teeth 70 on the piston 62 to move teeth 72 on the center column 48, which in turn causes corresponding back-and-forth rotational movement of the center column 48 about the steering axis 44. Thus, operation of the steering actuator 56 causes the rack and pinion 68 to rotate the steering column 46 together with the lower gearcase 38 about the steering axis 44 with respect to the steering housing 28 and powerhead 22. The supply of pressurized hydraulic fluid from the pump 58 to the cylinder 60 can be controlled by a conventional valve arrangement and a conventional operator input device for controlling steering movement of an outboard motor, such as a steering wheel, joystick, and/or the like, all as is conventional.

Figure 8:
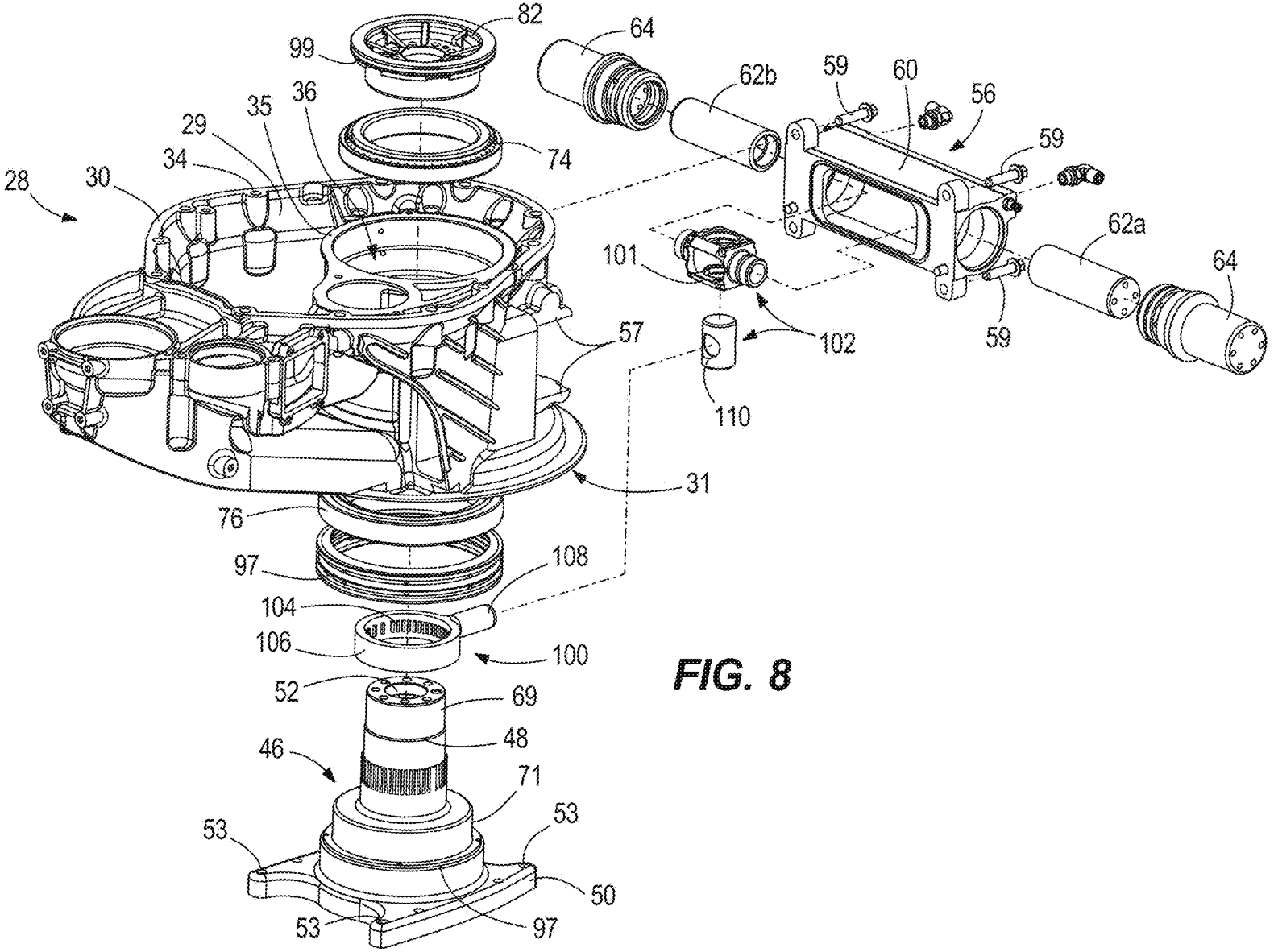
FIG. 8 is an exploded view looking showing the steering housing, steering actuator and a steering column according to the second embodiment.

Referring to FIGS. 3, 8, and 10, upper and lower bearings 74, 76 facilitate smooth rotational movement of the steering column 46 and lower gearcase 38 with respect to the steering housing 28. The upper bearings 74 are located above the rack and pinion 68 between a top end cap 82 having an outer perimeter seal 99 and outer upper bearing surface 69 (FIG. 3) on the steering column 46, and an inner upper bearing surface 81 (FIG. 10) on the center-column 35 in the steering housing 28. The lower bearings 76 are located below the rack and pinion 68 and between a lower outer bearing surface 71 (FIG. 3) on the steering column 46 and a lower inner bearing surface 85 (FIG. 10) in the on the center-column 35. Outer perimeter seals 97 are disposed on a lower sealing surface 97 on the steering column 47. A seal cap 93 (FIG. 3), is disposed on top of the top end cap 82. The upper and lower bearings 74, 76 surround the steering column 46 and are located radially between the steering column 46 and the inner perimeter of the through-bore 36 in the steering housing 28. The type and configuration of the upper and lower bearings 74, 76 can vary from what is shown. In the illustrated example, the upper and lower bearings 74, 76, each comprise inner and outer races containing tapered roller bearings that extend transversely (angular) with respect to the steering axis 44. The top end cap 82 is coupled to the top of the steering column 46 by bolts 83 (FIG. 3) and retains the upper bearings in place.

Figure 6:
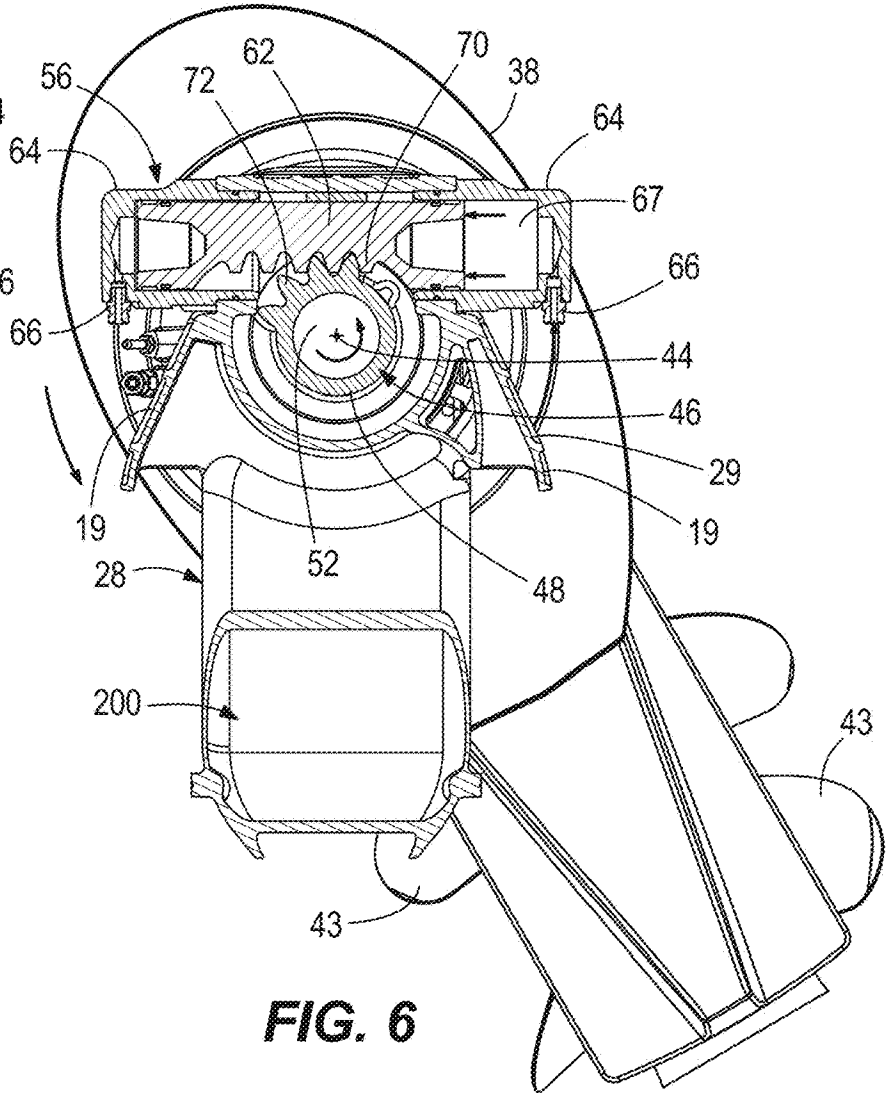
FIGS. 5 and 6 are top views of the first embodiment, via section 4-4, showing steering motions of the lower gearcase with respect to the steering housing.
Figure 5:
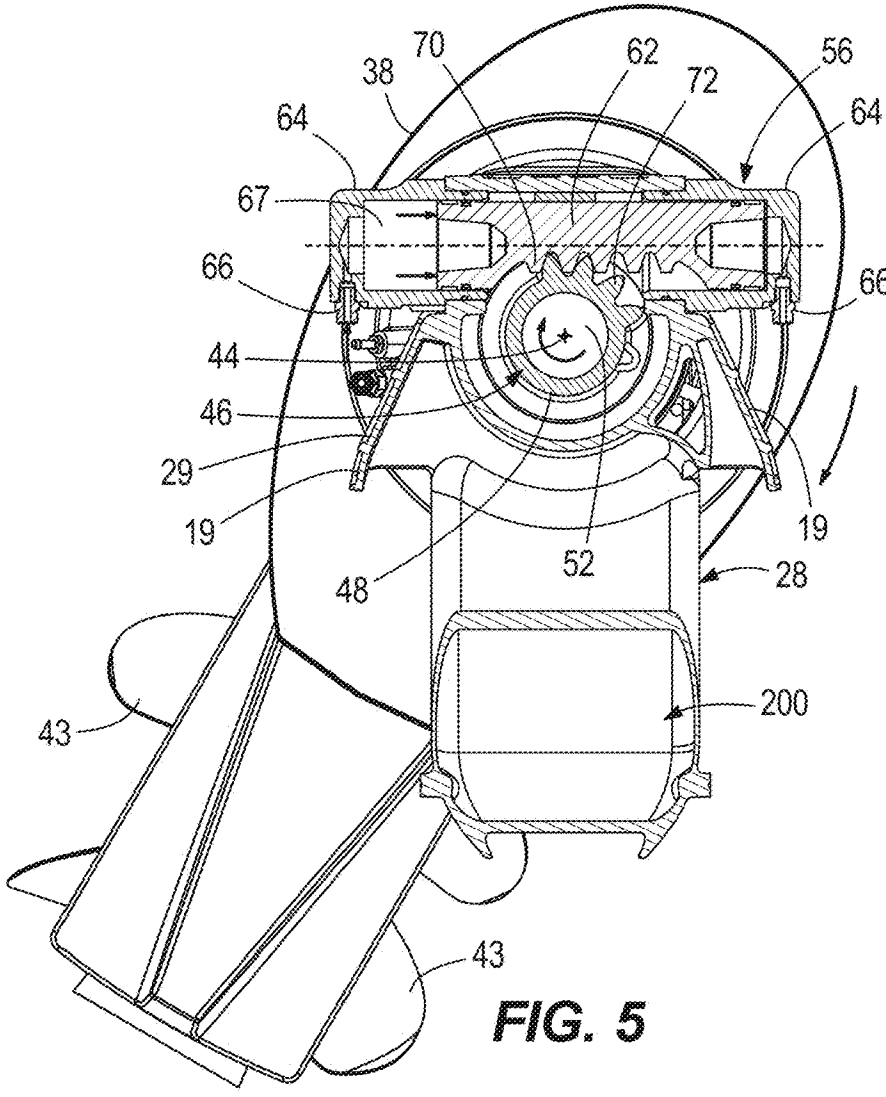

FIGS. 5 and 6 depict steering motions of the lower gearcase 38 with respect to the steering housing 28. In FIG. 5, the noted operator input device controls the pump 58 to supply pressurized hydraulic fluid to the port side chamber 67, which forces the piston 62 to slide to the starboard side, as shown by arrows. Starboard movement of the piston 62 causes the rack and pinion 68 to rotate the steering column 46 and lower gearcase 38 with respect to the steering housing 28, as shown by the arrow. In FIG. 6, the noted operator input device controls the pump 58 to supply pressurized hydraulic fluid to the starboard side chamber 67, which forces the piston 62 to slide to the port side, as shown by the arrow. Port movement of the piston 62 causes the rack and pinion 68 to rotate the steering column 46 and lower gearcase with respect to the steering housing 28, as shown by the arrow.

Figure 7:
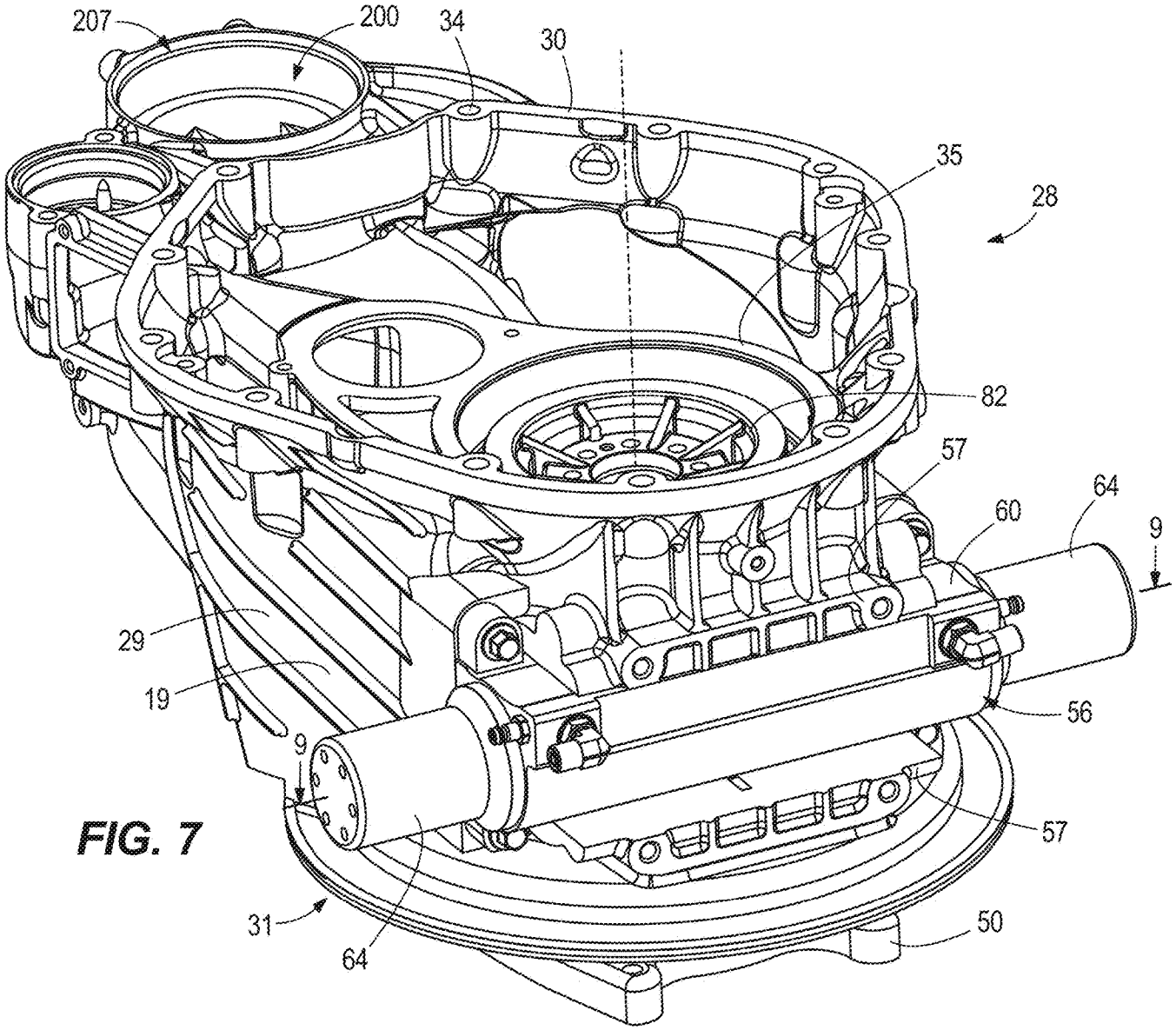
FIG. 7 is a perspective view looking down at a steering housing of an outboard motor according to a second embodiment.
Figure 9:
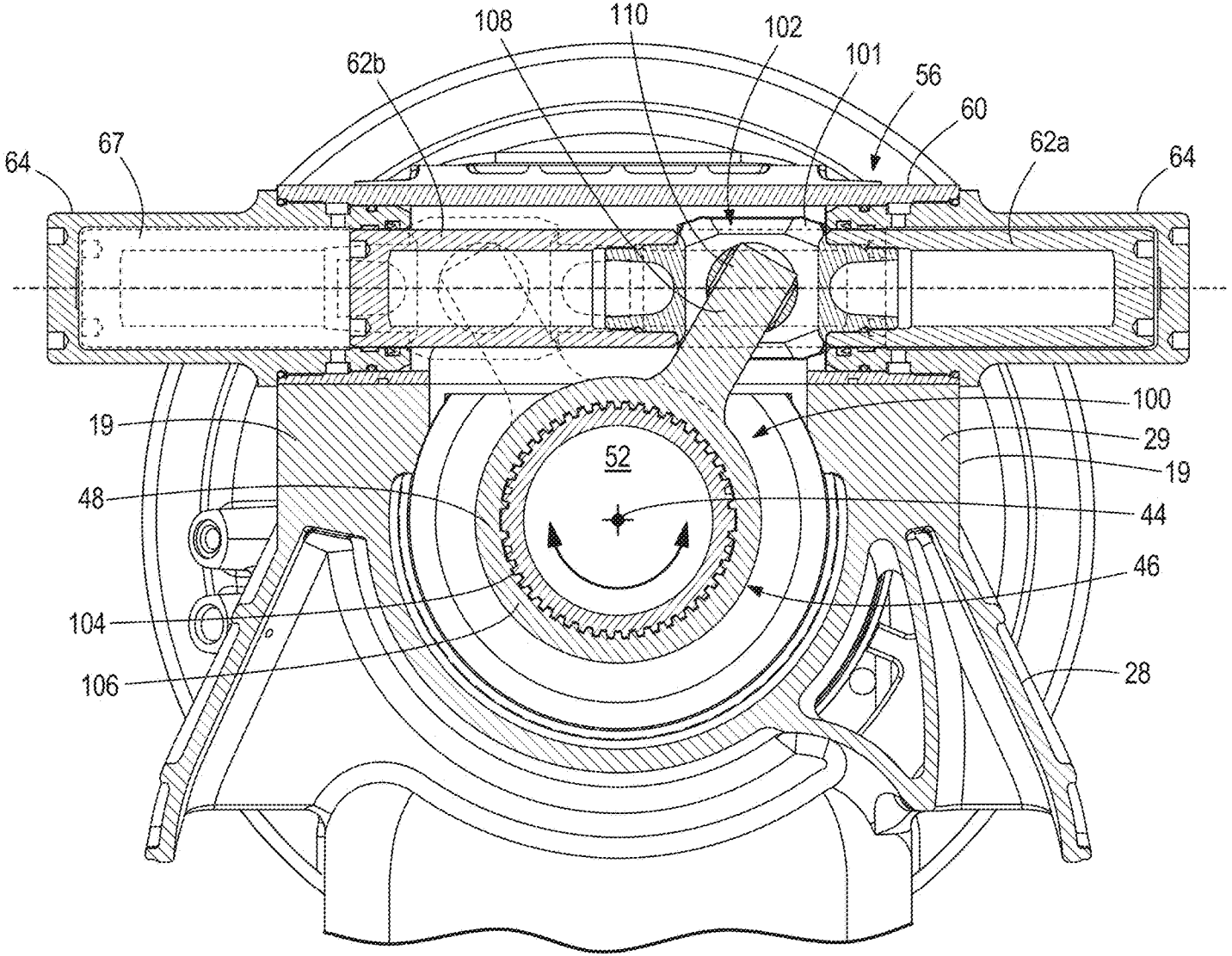
FIG. 9 is a view of section 9-9, taken in FIG. 7.

FIGS. 7-9 depict a second embodiment of the outboard motor 20. Many features that are the same or like the first embodiment have like reference numbers in the figures. The second embodiment differs from the first embodiment in that the steering actuator 56 is mounted to an outer surface of the main body 29 of the steering housing 28 by bolts 59, rather than being formed with the main body 29. Mounting flanges 57 outwardly extend on top and bottom of the outer surface and help retain the steering actuator 56 in place. Further, the steering actuator 56 is coupled to the steering column 46 by a yoke 100 and trunnion 102 instead of the rack and pinion 68. The yoke 100 is coupled to the steering column 46 via mated radially oriented and axially-extending splines 104 disposed on the outer diameter of the steering column 46 and around an inner perimeter of the body 106 of the yoke 100. The yoke 100 has an arm 108 that protrudes from the body 106 via a through-bore in the outer surface of the steering housing 28 and into a rotatable cylinder 110 of the trunnion 102. The body 101 of the trunnion 102 is located in the middle of opposing piston halves **62*a*, 62*b*. Referring to FIG. 9, movement of the piston 62*a*, 62*b* in the cylinder 60 (as described herein above) causes movement of the trunnion 102, via the arm 108 and rotatable cylinder 110, movement of the trunnion 102 causes rotation of the steering column 46, which in turn causes rotation of the lower gearcase 38, as shown. Thus, operation of the steering actuator 56 causes the yoke 100 and trunnion 102 to rotate the steering column 46 and lower gearcase 38 about the steering axis 44 with respect to the steering housing 28 and powerhead 22**.

The above-described embodiments thus provide novel outboard motor configurations in which the powerhead remains stationary during steering motion of the lower gearcase and associate rudder.

During further research and experimentation, the present inventors have determined that outboard motor configurations having a steerable lower gearcase present challenges with respect to conveyance of cooling water from the lower gearcase to the powerhead and conveyance of exhaust gas from the powerhead to the lower gearcase. Particularly, the present inventors have identified challenges with respect to how to convey the cooling water and the exhaust gas efficiently and effectively between two components that rotate relative to each other. The present disclosure provides results of the present inventors' efforts to overcome these challenges.

Referring now to FIGS. 10-13, an exhaust conduit 200 conveys exhaust gas from the powerhead 22 through the steering housing 28 and into the lower gearcase 38 for discharge from the outboard motor 20, for example via passageways 17 in the hubs of the propellers 43. Referring to FIG. 10, the exhaust conduit 200 has a first exhaust conduit portion 202 that conveys the exhaust gas through the steering housing 28, a second exhaust conduit portion 204 that conveys the exhaust gas from the steering housing 28 to the lower gearcase 38, and a third exhaust conduit portion 206 that conveys the exhaust gas through the lower gearcase 38 for discharge from the outboard motor 20. The exhaust gas flows from upstream to downstream, and more specifically from the first exhaust conduit portion 202 to the second exhaust conduit portion 204, and then to the third exhaust conduit portion 206. The configuration of the first, second and third exhaust conduit portions 202, 204, 206 can vary from what is shown and described.

In the illustrated example, the first exhaust conduit portion 202 is integrally formed with the steering housing 28 but is located aftwardly of the main body 29 so that a gap 201 exists there between. The first exhaust conduit portion 202 has an upstream end 207 that receives the exhaust gas from an exhaust tube 209 (FIG. 1) located aftwardly of the driveshaft housing 26 (see FIG. 1), a transversely extending middle portion 211 that curves forwardly from the upstream end 207 towards the main body 29, and a downstream end 208 that discharges the exhaust gas to the second exhaust conduit portion 204. Thus, via the first exhaust conduit portion 202, the exhaust gas flows downwardly and forwardly relative to the main body 29 of the steering housing 28, as shown by arrows.

The second exhaust conduit portion 204 annularly extends all the way around the steering column 46 (see FIG. 12). Generally, the second exhaust conduit portion 204 has an upstream end 210 (see FIG. 10) that receives the exhaust gas from the first exhaust conduit portion 202 and a downstream end 212 (see FIG. 12) that discharges the exhaust gas to the third exhaust conduit portion 206. As further described herein below and shown in FIGS. 13 and 14, the downstream end 208 of the first exhaust conduit portion 202 and the upstream end 210 of the second exhaust conduit portion 204 advantageously remain connected as the lower gearcase 38 is steered about the steering axis 44 with respect to the steering housing 28.

Figure 11:
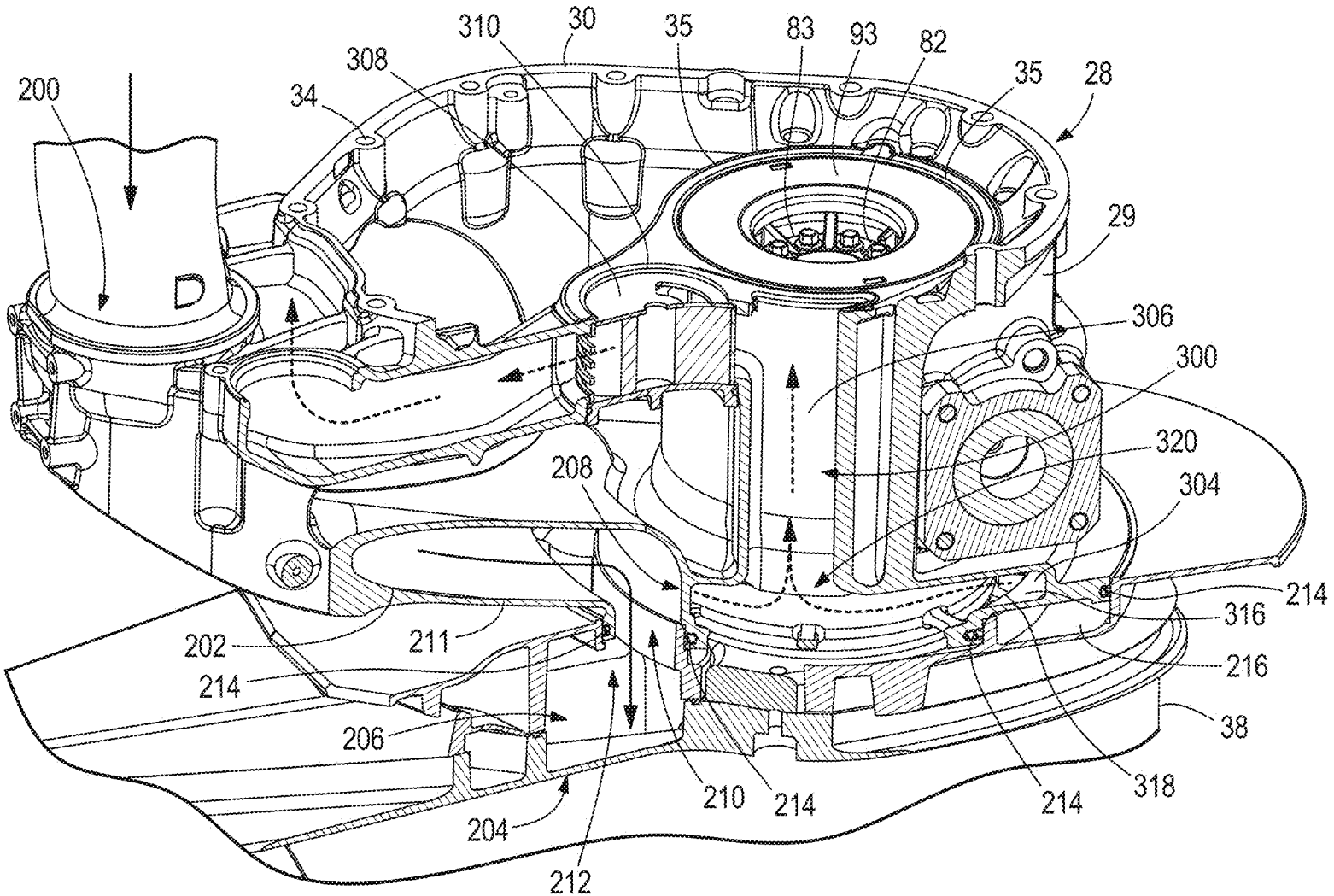
FIG. 11 is a partial sectional view showing flow of the exhaust gas and cooling water through the steering housing of the first embodiment.

As shown in FIGS. 10 and 11, the downstream end 208 of the first exhaust conduit portion 202 axially overlaps with the upstream end 210 of the second exhaust conduit portion 204. Referring to FIG. 12, the bottom of the steering housing 28 has concentric radially inner and outer annular sidewalls 213, 215 that extend downwardly from a bottom face 217 of the steering housing 28 and around an entire periphery of the through-bore 36. Corresponding concentric radially inner and outer annular sidewalls 219, 221 extend upwardly from the gearcase cover 54 and around an entire periphery of the through-bore 36. The annular sidewalls 219, 221 radially overlap and rotate with respect to the annular sidewalls 213, 215 (see e.g., FIG. 10, reference numbers omitted) during steering of the lower gearcase 38 with respect to the steering housing 28. Thus, the second exhaust conduit portion 204 forms an annular channel 216 around the steering column 46, through which the exhaust gas can travel as the exhaust gas is conveyed to the third exhaust conduit portion 206, and as the lower gearcase 38 is steered about the steering axis 44 and with respect to the steering housing 28. The upstream end of the 210 of the second exhaust conduit portion 204 is defined by the annular open top end of the annular channel 216 (see FIG. 12). The annular channel 216 is defined by the annular sidewalls 213, 215, bottom face 217, and an opposing top face 218 of the top of the gearcase cover 54.

Referring to FIGS. 10 and 11, O-ring seals 214 are radially disposed between the annular sidewalls 213 and 219 and 215 and 221, respectively. The O-ring seals 214 advantageously maintain a fluid tight seal between the respective sidewalls, and thus between the first and second exhaust conduit portions 202 and 204, and between the second and third exhaust conduit portions 206 and 206, as the lower gearcase 38 is steered with respect to the steering housing 28. During steering movements, the downstream end 208 of the first exhaust conduit portion 202 advantageously rotates peripherally along the annular channel 216 (see FIGS. 13 and 14) so that the exhaust gas is discharged to the second exhaust conduit portion 204 at a peripheral location along the annular channel 216 that varies depending upon the steering position of the lower gearcase 38 with respect to the steering housing 28. The downstream end 212 of the second exhaust conduit portion 204 is defined by a bore 222 (see FIG. 12) axially extending through the top face 218 along the aftward side of the driveshaft 24. The bore 222 conveys the exhaust gas to the third exhaust conduit portion 206 for discharge from the outboard motor 20, as shown in FIG. 10.

Thus, exhaust gas is conveyed from the powerhead 22 and for discharge from the outboard motor 20 via the exhaust conduit 200 as follows: The exhaust gas is discharged from an exhaust manifold on the powerhead 22 to the exhaust tube 209. The exhaust gas is discharged from the exhaust tube 209 to the first exhaust conduit portion 202. From the first exhaust conduit portion 202, the exhaust gas is discharged downwardly into the annular channel 216 at a location that will vary depending upon the steering position of the lower gearcase 38 with respect to the steering housing 28. The exhaust gas can travel about the annular channel 216 to the bore 222 through which the exhaust gas is discharged to the third exhaust conduit portion 206. From the third exhaust conduit portion 206, the exhaust gas is laterally discharged via the passageways 17 in the propellers 43.

Referring to FIGS. 10 and 11, a cooling water conduit 300 conveys cooling water from the lower gearcase 38 through the steering housing 28 and to the powerhead 22 for cooling of the powerhead 22 and/or other components of the outboard motor 20. In general, the cooling water conduit 300 includes a first cooling water conduit portion 302 (FIG. 10) that conveys the cooling water through the lower gearcase 38, a second cooling water conduit portion 304 that conveys the cooling water out of the lower gearcase 38 and into the steering housing 28, and third cooling water conduit portion 306 (see FIG. 11) that conveys the cooling water through the steering housing 28 and for subsequent conveyance to the powerhead 22 and/or the other components of the outboard motor 20. A cooling water pump 308, which can be a conventional electrically-driven pump or mechanically-driven pump, generates a pumping force which, as described further herein below, draws the cooling water into the outboard motor 20 from the surrounding body of water in which the outboard motor 20 is being operated and pumps the cooling water upwardly in the outboard motor towards the powerhead 22. The cooling water pump 308 thus causes the cooling water to flow from upstream to downstream through the cooling water conduit 300. The location and configuration of the cooling water pump 308 can vary from what is shown. In the illustrated example, the cooling water pump 308 is located in a pump cavity 310, which is defined in the steering housing 28, alongside the center-column 35 of the steering housing 28, and more particularly in direct fluid connection with the third cooling water conduit portion 306.

Referring to FIGS. 10 and 11, the first cooling water conduit portion 302 has an upstream end 312 (FIG. 10) that receives cooling water from the surrounding body of water via intake ports 314 located on opposite sides of the lower gearcase 38. The first cooling water conduit portion 302 has a downstream end 316 located at the top of the lower gearcase 38 and configured to discharge the cooling water to the second cooling water conduit portion 304, as further described herein below. The second cooling water conduit portion 304 has an upstream end 318 (FIG. 11) that receives the cooling water from the downstream end 316 of the first cooling water conduit portion 302, and a downstream end 320 that discharges the cooling water to the third cooling water conduit portion 306. As further described herein below and shown in FIGS. 13 and 14, the downstream end 316 of the first cooling water conduit portion 302 and the upstream end 318 of the second cooling water conduit portion 304 advantageously remain connected as the lower gearcase 38 is steered about the steering axis 44 with respect to the steering housing 28.

Referring to FIGS. 10-14, the downstream end 316 of the first cooling water conduit portion 302 axially overlaps with the upstream end 318 of the second cooling water conduit portion 204. More particularly, as shown in FIG. 12, the bottom of the steering housing 28 has concentric radially inner and outer annular sidewalls 313, 213 that extend downwardly from the bottom of the steering housing 28 and around an entire periphery of the through-bore 36. The annular sidewalls 313, 213 radially overlap and rotate with respect to annular sidewalls 219, 315 on the lower gearcase 38, during steering of the lower gearcase 38 with respect to the steering housing 28. Thus, the second cooling water portion 304 forms an annular channel 317 around which the cooling water can travel as it is conveyed by the second cooling water conduit portion 304 to the third cooling water portion 306, and as the lower gearcase 38 is steered about the steering axis 44 and with respect to the steering housing 28. The downstream end 316 of the first cooling water conduit portion 302 is defined by the annular open end 317 of the first cooling water conduit portion 304. The annular channel 317 extends around an entire periphery of the driveshaft 24. The downstream end 320 of the second cooling water conduit portion 304 is defined by a bore (FIG. 11) on an aftward side of the driveshaft 24.

Figure 14:
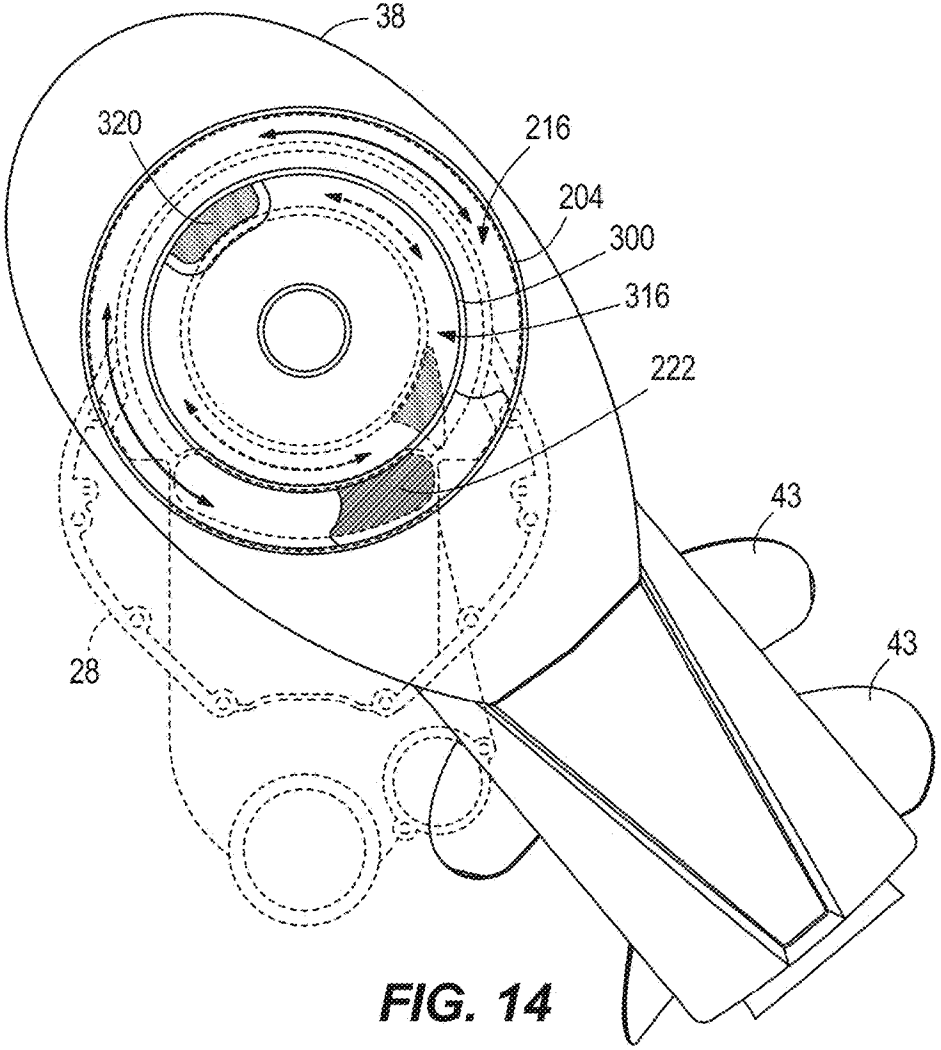
FIGS. 13 and 14 are top views showing flow of the exhaust gas and cooling water between the lower gearcase and steering housing.
Figure 13:
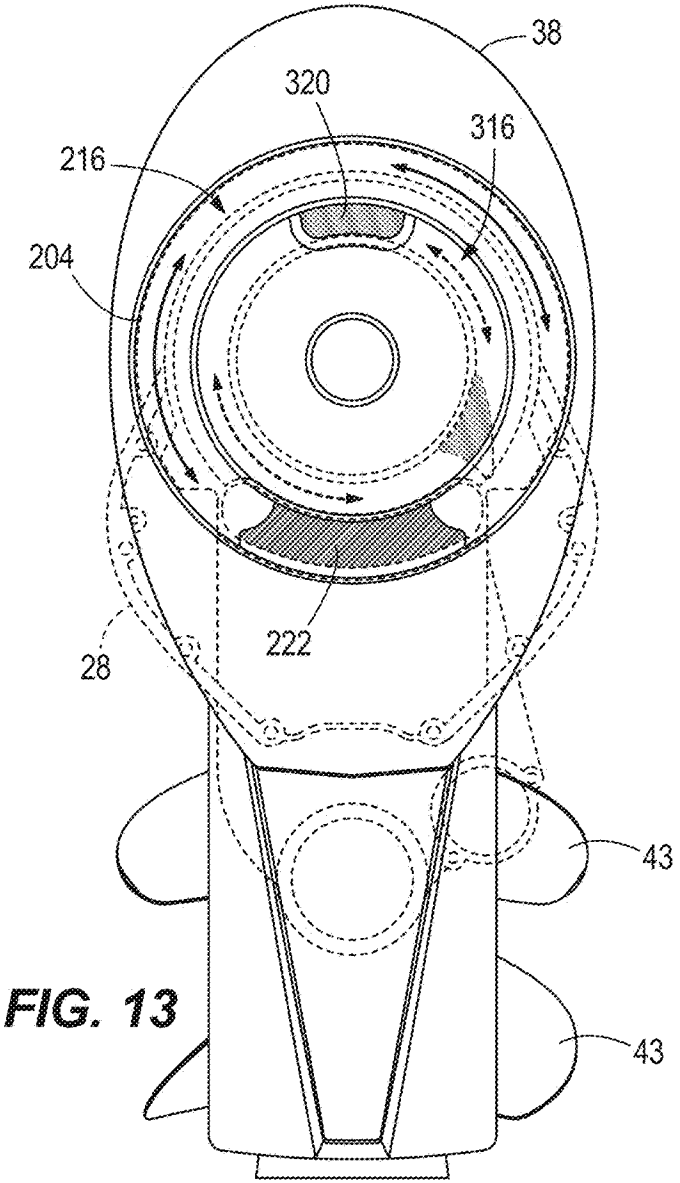

Seals 214 advantageously maintain a fluid tight seal between the respective sidewalls, and thus between the first and second cooling water conduit portions 302 and 304 as the lower gearcase 38 is steered with respect to the steering housing 28. Referring to FIGS. 13 and 14, during steering movements, the downstream end 316 of the first cooling water conduit portion 302 advantageously rotates along the annular channel 317 as that the cooling water is discharged to the second cooling water conduit portion 304 at a radial location along the annular channel 317 that varies depending upon the steering position of the lower gearcase 38 with respect to the steering housing 28.

Thus, the cooling water conduit 300 extends from the lower gearcase 38 towards the powerhead 22, and particularly around an entire periphery of the driveshaft 24. Between the lower gearcase 38 and the powerhead 22, the exhaust conduit 200 and the cooling water conduit 300 are concentric about the driveshaft 24. Between the powerhead 22 and the lower gearcase 38, the exhaust conduit 200 circumscribes the cooling water conduit 300.

Optionally, the configurations shown and described herein above can have steering angular travel limited, for example to +30°, via for example adjustable hard stops or electronic means. In certain examples, the gearcase can have the ability to turn up to +47°. This permits the manufacturer of the outboard motor to produce and ship a single outboard motor from the factory to the boat builder, giving the boat builder flexibility to program the outboard motor to steer a certain number of degrees that is required based on the application.

Figure 15:
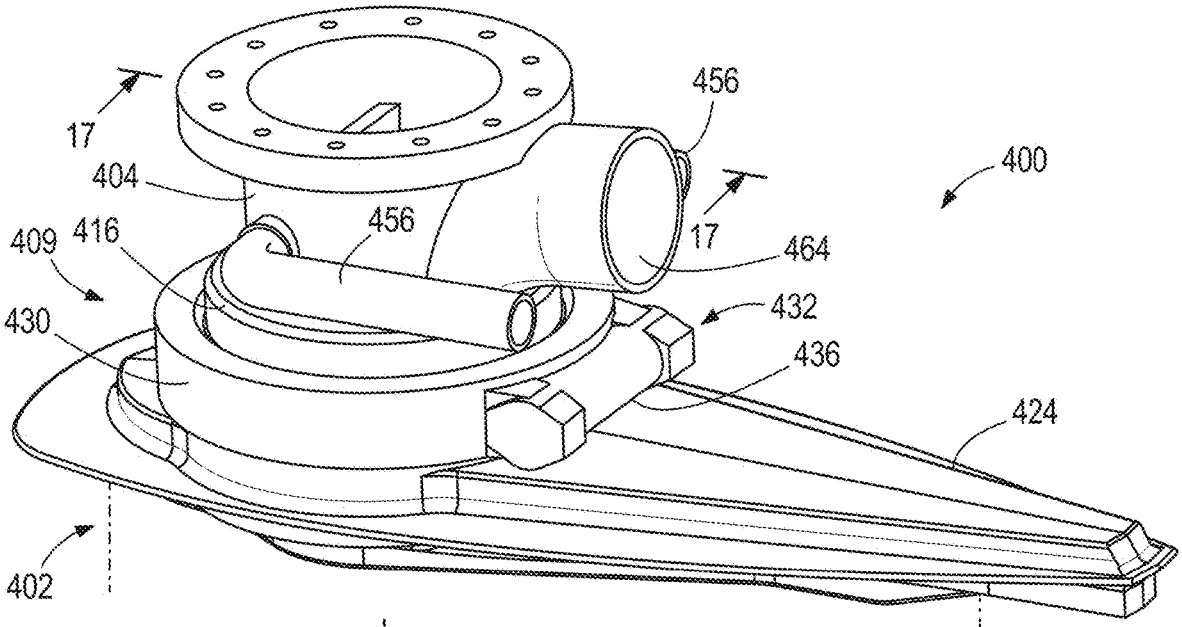
FIG. 15 is a perspective view of a third embodiment of a steering housing and lower gearcase according to the present disclosure
Figure 16:
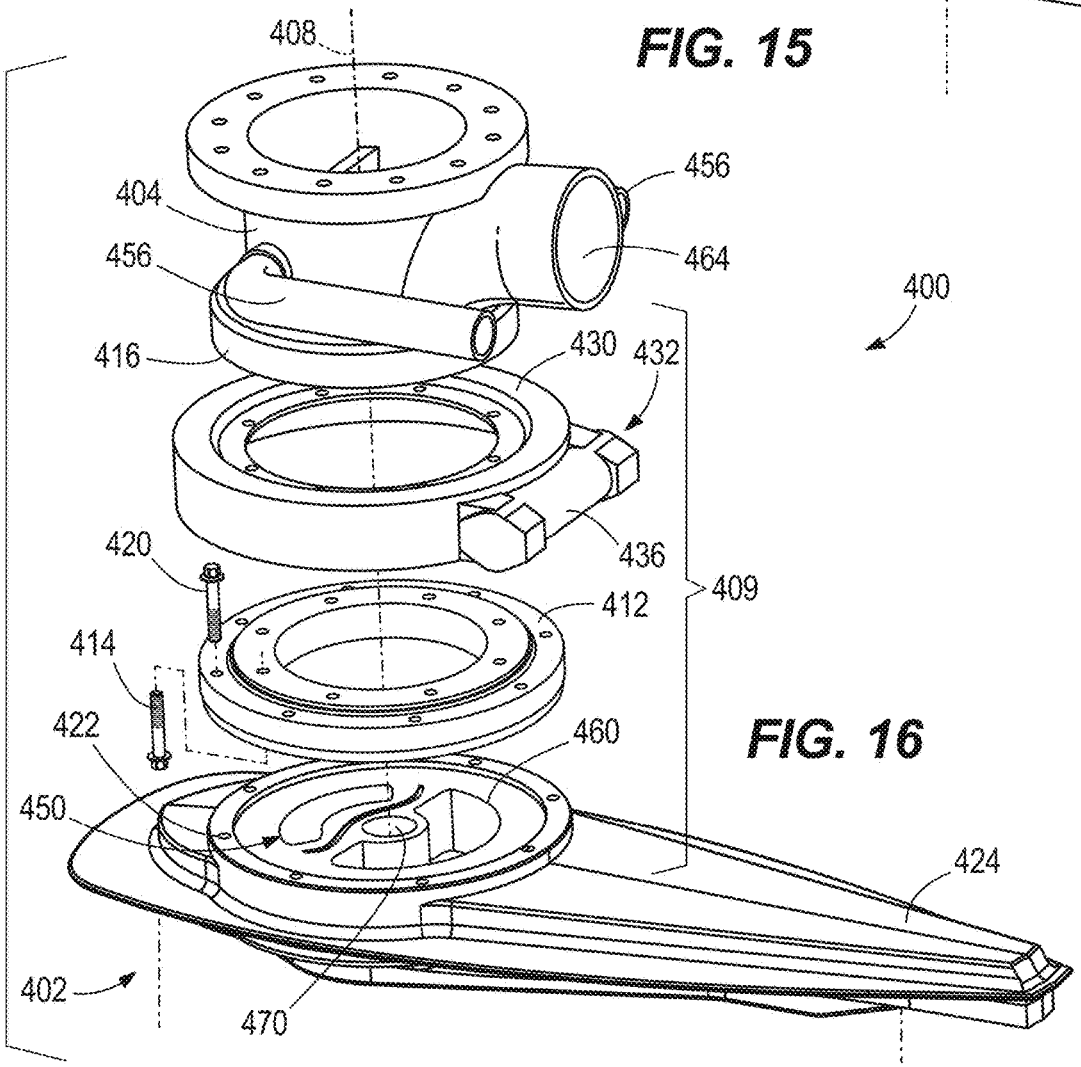
FIG. 16 is an exploded view of the embodiment of FIG. 15.
Figure 17:
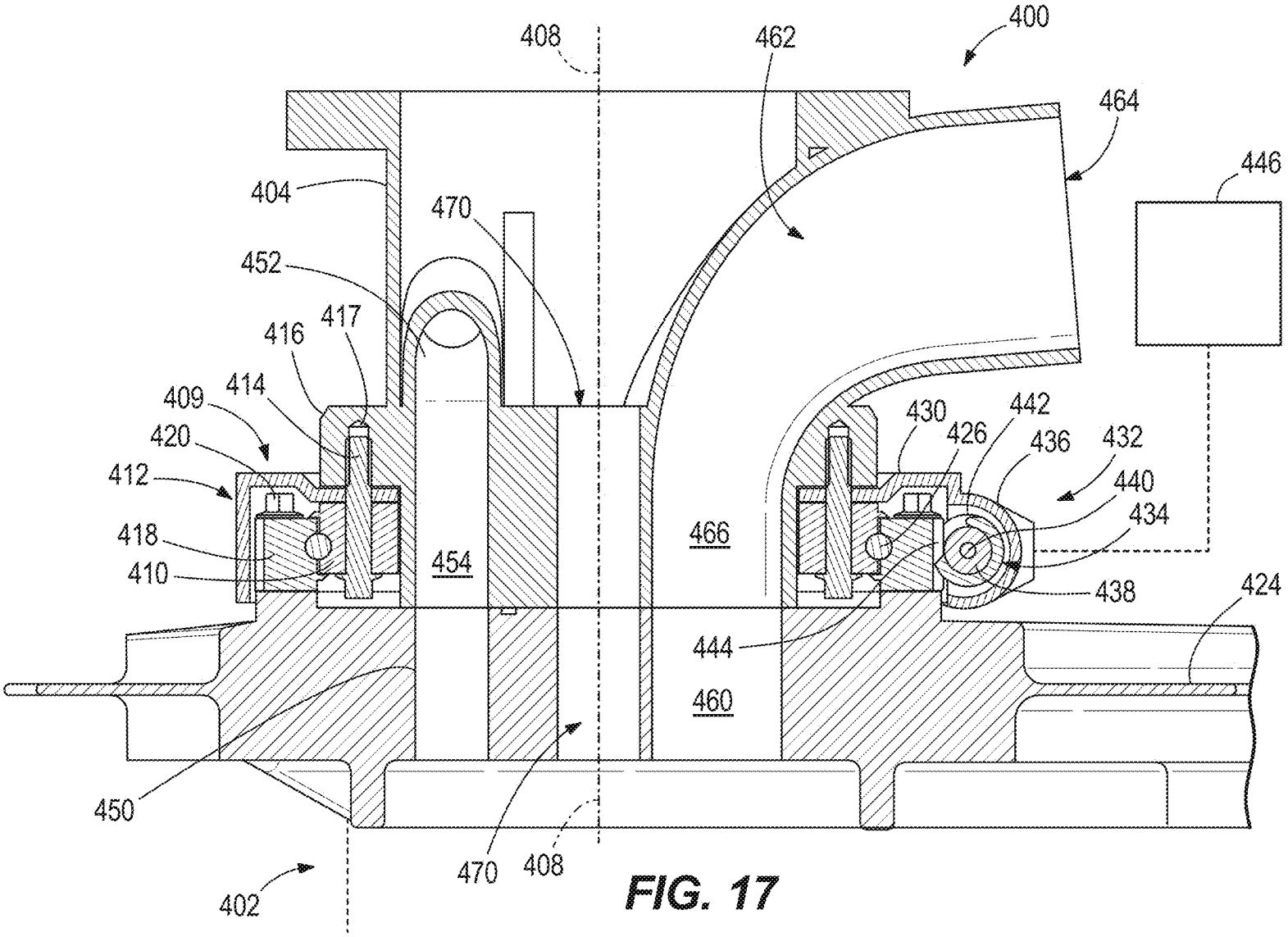
FIG. 17 is a view of Section 17-17, taken in FIG. 15.
Figure 18:
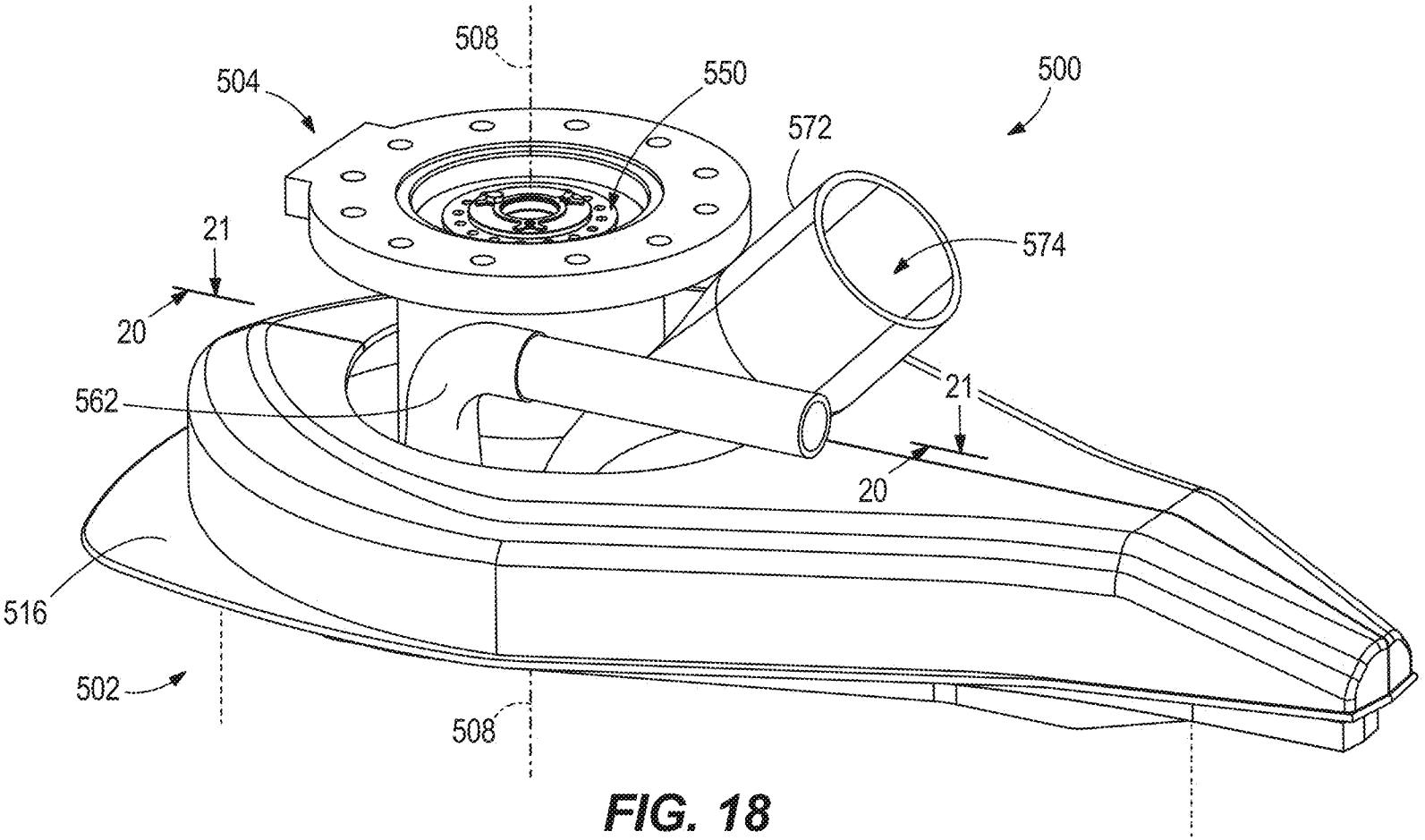
FIG. 18 is a perspective view of a fourth embodiment of a steering housing and lower gearcase according to the present disclosure.

FIGS. 15-17 depict portions of a third embodiment of a marine drive 400, which for example can be an outboard motor, stern drive, and/or the like. Although not shown in FIGS. 15-17, and just like the first and second embodiments described herein above with respect to FIGS. 1-6 and 7-9, respectively, the marine drive 400 has a powerhead which causes rotation of a driveshaft, which in turn causes rotation of a propulsor, which for example can include one or more propellers for propelling the marine drive 400 in a body of water. As shown in FIGS. 15-17, the marine drive 400 has a gearcase 402 configured to support a propulsor for propelling the marine drive 400 in a body of water. The gearcase 402 has a gearcase cover 424. A steering housing 404 is located between the noted powerhead and gearcase 402. As described herein above regarding the first and second embodiments, a driveshaft or an extension thereof (not shown) extends through the steering housing 404 and is operatively coupled to the propulsor in the gearcase 402.

Like the first and second embodiments, the gearcase 402 is steerable relative to the steering housing 404 about a steering axis 408 which is coaxial with the noted driveshaft. In this embodiment, the gearcase 402 and steering housing 404 are connected at a steering joint 409 having an annular bearing 412. As shown in FIG. 17, the annular bearing 412 has an inner bearing race 410 that is fixed to a lower mounting flange 416 on the steering housing 404 by threaded fasteners 414 extending through the annular bearing 412 and into threaded engagement with threaded holes 417 in the lower mounting flange 416. The annular bearing 412 also has an outer bearing race 418 that surrounds the inner bearing race 410. The outer bearing race 418 is fixed to the gearcase cover 424 by threaded fasteners 420 extending through the annular bearing 412 and into engagement with threaded holes 422 in the gearcase cover 424. As such, the inner and outer bearing races 410, 418 are sandwiched between and remain axially fixed relative to the steering housing 404 and the gearcase cover 424, respectively. A plurality of ball bearings 426 is located radially between the inner and outer bearing races 410, 418. The ball bearings 426 are configured such that the outer bearing race 418 is rotatable relative to the inner bearing race 410 about the steering axis 408.

As shown in FIG. 17, an annular cover 430 is fixed to the lower mounting flange 416 of the steering housing 404 by the fasteners 414. The annular cover 430 is sandwiched between the top of the annular bearing 412 and the lower mounting flange 416. A steering mechanism 432 is located on the perimeter of the annular cover 430. The steering mechanism 432 is configured to steer the gearcase 402 relative to the steering housing 404 about the steering axis 408. In this embodiment, the steering mechanism 432 includes a worm drive 434 contained in a worm drive housing 436. The worm drive 434 has a spool 438 that is caused to rotate about a spool axis 440 extending transversely to the steering axis 408. The spool 438 has helical surface grooves 442 that engage with corresponding helical grooves 444 on the outer perimeter of the outer bearing race 418 such that rotation of the spool 438 about its spool axis 440 causes rotation of the outer bearing race 418 about the inner bearing race 410. Rotation of the outer bearing race 418 about the inner bearing race 410 causes rotation of the gearcase 402 relative to the steering housing 404, via the noted fixed engagement of fasteners 414 with the gearcase cover 424. The worm drive 434 is powered by a conventional bi-directional electric motor 446 associated with the powerhead and/or by any other conventional means for causing rotation of the spool 438. Rotation of the worm drive 434 in a first direction causes steering movement of the gearcase 402 in a first direction, for example the port direction. Rotation of the worm drive 434 in an opposite, second direction causes steering movement of the gearcase 402 in an opposite second direction, for example the starboard direction.

Referring to FIGS. 16-17, the steering joint 409 has passages through which cooling water is pumped from the body of water in which the marine drive 400 is operated to the noted powerhead. Advantageously, the cooling water can be conveyed through the steering joint 409 during and throughout the above-described steering movements of the gearcase 402. An oblong, widened cooling water channel 450 extends through the gearcase cover 424 and is configured to convey cooling water upwardly via passages in the gearcase 402, for example as described herein above in the first and second embodiments. Referring to FIG. 17, a cooling water passage 452 is formed in the steering housing 404. The cooling water passage 452 has an inlet end 454 that faces and receives the cooling water from the widened cooling water channel 450. As shown in FIG. 16, the widened cooling water channel 450 has a width that curves along an arc, i.e., radially relative to the steering axis 408. The inlet end 454 thus remains aligned with and open to receiving cooling water from the cooling water channel 450 throughout steering movement of the gearcase 402 about the steering axis 408. Steering movement of the lower gearcase 402 moves the widened cooling water channel 450 about the steering axis 408 however the arc-shape of the widened cooling water channel 450 causes it to remain aligned with the inlet end 454. Downstream of the inlet end 454, the cooling water passage 452 splits into port and starboard cooling water passage sections 456 which are located on opposite sides of the steering housing 404. The port and starboard cooling water passage sections 456 further convey the cooling water to the powerhead.

Referring to FIGS. 16-17, the steering joint 409 also has passages through which exhaust is conveyed from the noted powerhead to the gearcase 402, and for discharge to the body of water in which the marine drive 400 is operated. An oblong, widened exhaust channel 460 extends through the gearcase cover 424 and is configured to convey exhaust gas downwardly for discharge via the lower gearcase 402. Referring to FIG. 17, an exhaust passage 462 is formed through the steering housing 404. The exhaust passage 462 has an upstream inlet end 464 that receives exhaust from the powerhead and a downstream outlet end 466 that faces and discharges exhaust to the exhaust channel 460. As shown in FIG. 16, the exhaust channel 460 extends along an arc, radially relative to the steering axis 408, such that the outlet end 466 remains aligned with and open to the exhaust channel 460 throughout steering movement of the gearcase 402 relative to the steering housing 404. In this way the exhaust passage 462 is able to discharge exhaust to the exhaust channel 460 during and throughout steering movement of the gearcase 402 about the steering axis 408. A center passage 470 is formed through the steering housing 406 and gearcase cover 424 for the driveshaft or extension thereof, which as explained above extends along the steering axis 408 from the powerhead into operable engagement with the noted propulsor in the gearcase 402.

FIGS. 18-21 depict portions of a fourth embodiment of a marine drive 500, which for example can be an outboard motor, stern drive, and/or the like. Although not shown in FIGS. 18-21, and just like the embodiments described herein above, the marine drive 500 has a powerhead which causes rotation of a driveshaft, which in turn powers a propulsor. As shown in FIGS. 18-21, the marine drive 500 has a gearcase 502 configured to support the propulsor. The gearcase 502 has a gearcase cover 516. A steering housing 504 is located between the noted powerhead and the gearcase 502 and, as described herein above, the driveshaft or an extension thereof extends through the steering housing 504 and is operatively coupled to the propulsor in the gearcase 502.

Figure 20:
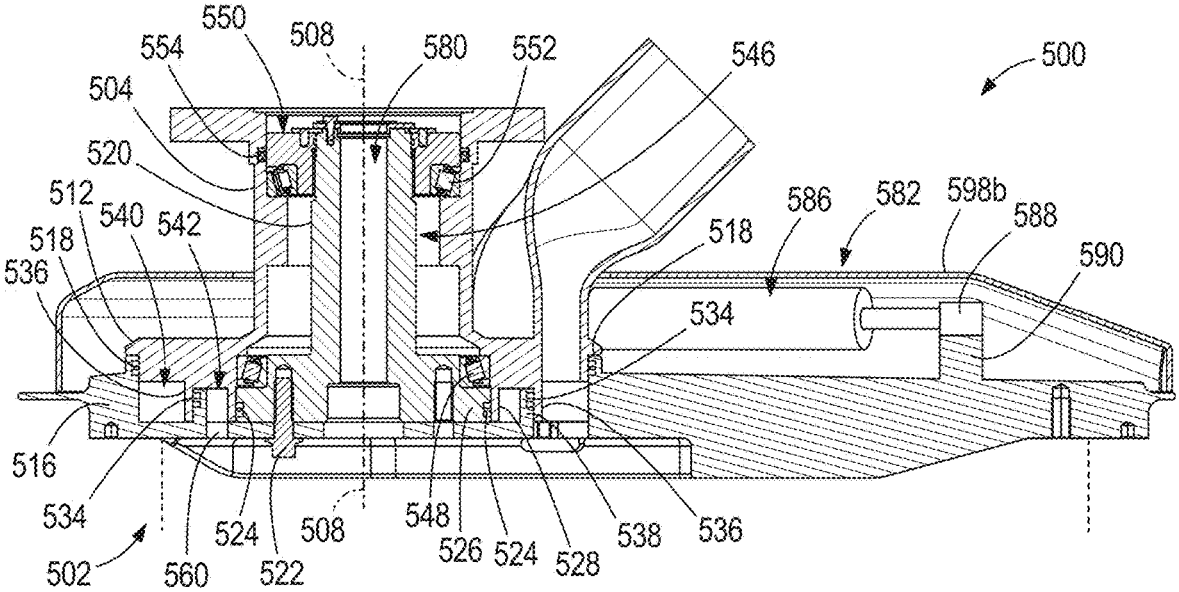
FIG. 20 is a view of Section 20-20, taken in FIG. 18.

Like the first, second and third embodiments, the gearcase 502 is steerable relative to the steering housing 504 about a steering axis 508 which is coaxial with the noted driveshaft. The gearcase 502 and steering housing 504 are connected at a steering joint 510 formed by an annular flange 512 on the steering housing 504 which is seated in an annular recess 514 defined in the gearcase cover 516. Referring to FIG. 20, annular seals 518 are radially sandwiched between the outer perimeter of the annular flange 512 and the inner perimeter of the annular recess 514. A steering column 520 is mounted by fasteners 522 to the gearcase cover 516, at the center of the annular recess 514. Annular seals 524 are radially sandwiched between the outer perimeter of a lower mounting flange 526 on the steering column 520 and the inner perimeter of an annular end wall 528 extending downwardly into the annular recess 514 from the annular flange 512 on the steering housing 504. An annular space is defined between the inner perimeter of the annular recess 514 and the outer perimeter of the annular end wall 528. Annular seals 534 are sandwiched between intermediate annular walls 536, 538 on the steering housing and gearcase cover 516, respectively. The intermediate annular walls 536, 538 and annular seals 534 separate the annular space into an annular exhaust passage 540 that circumscribes the steering column 520 and an annular cooling water passage 542 that circumscribes the steering column 520 and is located radially within the annular exhaust passage 540. It will thus be understood that annular seals 518, 524 seal the adjacent spaces in the central cavity, respectively, including for conveyance of cooling water and exhaust, as will be further described herein below.

Referring to FIG. 20, the steering column 520 extends into a central cavity 546 within the steering housing 504. Lower annular bearings 548 are disposed radially between the lower mounting flange 526 of the steering column 520 and the steering housing 504 along the sidewalls of the central cavity 546. A bearing cap 550 is coupled to the top of the steering column 520 and has upper annular bearings 552 disposed radially between the bearing cap 550 and the sidewalls of the central cavity 546. Upper and lower annular seals 554 are radially sandwiched between the bearing cap 550 and the sidewalls of the central cavity 546. The upper and lower annular bearings 548, 552 facilitate smooth rotational/steering movement of the steering housing 504 about the steering axis 508 relative to the gearcase 502, and particularly relative to the gearcase cover 516, as will be further described herein below.

Figure 21:
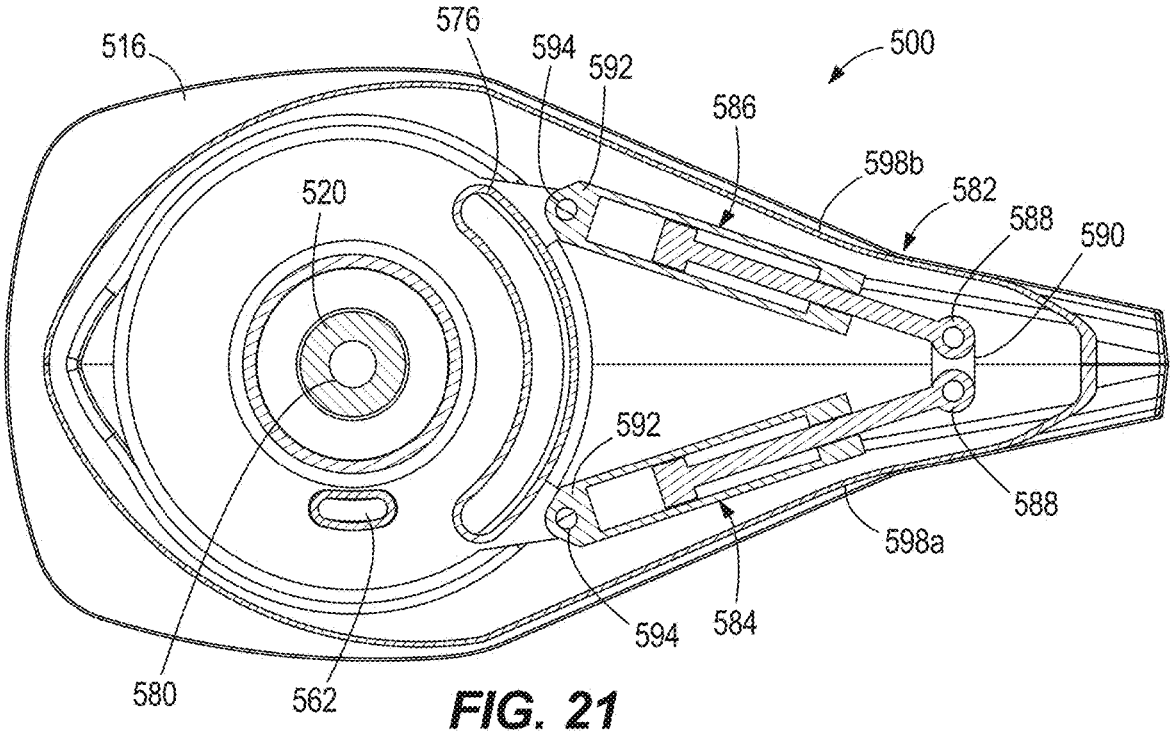
FIG. 21 is a view of Section 21-21, taken in FIG. 18.

Referring to FIGS. 20-21, the steering joint 510 defines passages through which cooling water is pumped from the body of water to the noted powerhead, including during and throughout steering movements of the gearcase 502. A cooling water passage 560 extends through the gearcase cover 516 and is configured to convey cooling water upwardly from the body water via passages in the gearcase 502 to the annular cooling water passage 542, for example as shown and described herein above in the first and second embodiments. Referring to FIG. 20 a cooling water passage 562 is formed in the steering housing 504 and has an inlet end 564 that faces and receives the cooling water from the cooling water channel 560. The inlet end 564 remains aligned with and open to receiving cooling water from the annular cooling water passage 542 during and throughout steering movement of the gearcase 502 about the steering axis 508.

The steering joint 510 also has passages through which exhaust is conveyed from the noted powerhead to the gearcase 502. Referring to FIGS. 20-21, an oblong, widened exhaust channel 570 extends through the gearcase cover 516 and is configured to convey exhaust gas downwardly for discharge via the lower gearcase 502. Referring to FIG. 20, an exhaust passage 572 is formed through the steering housing 504. The exhaust passage 572 has an upstream inlet end 574 for receiving exhaust from the powerhead and a downstream outlet end 576 that faces and discharges exhaust to the annular exhaust passage 540. As shown in FIG. 21, the exhaust channel 570 extends along an arc, radially relative to the steering axis 508, and remains aligned with and open to the annular exhaust passage 540 during steering movement of the gearcase 502 about the steering axis 508. A center passage 580 is formed through the steering housing 506 and gearcase cover 516 for the driveshaft or extension thereof, which extends along the steering axis 508, from the powerhead to the gearcase 502 and into operable engagement with the noted propulsor.

Figure 19:
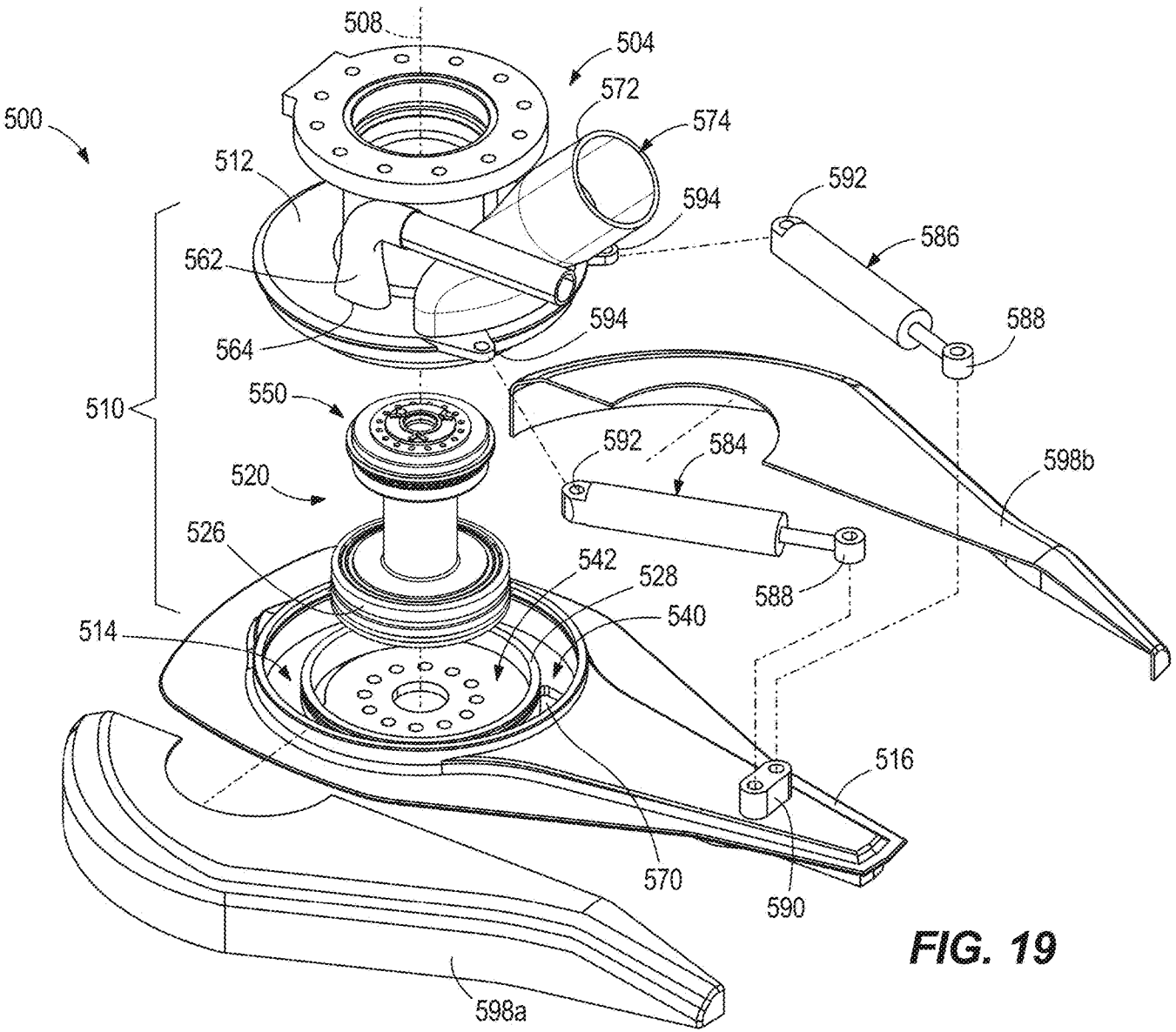
FIG. 19 is an exploded view of the embodiment in FIG. 18.

Referring to FIGS. 19-21, a steering mechanism 582 is provided for steering the gearcase 502 relative to the steering housing 504. In the illustrated example, the steering mechanism 582 includes first and second linear actuators 584, 586 that are disposed on opposite sides of the steering axis 508 and on opposite sides of the steering housing 504. Each of the first and second linear actuators 584, 586 have a first end 588 that is pivotably coupled to a mounting boss 590 on the gearcase cover 516 and an opposite, second end 592 that is pivotably coupled to mounting eyelets 594 on the annular flange 512 of the steering housing 504. In the illustrated example, the first and second linear actuators 584, 586 are piston-cylinders having piston rods that are extendable from the cylinder and retractable into the cylinder under force of hydraulic fluid, for example provided by a conventional hydraulic pump 596. This example is not limiting and the first and second linear actuators 584, 586 could have other configurations such as electrically powered screw-type linear actuators, and/or the like. Clamshell protective covers 598*a*, 598*b* are installed over the steering mechanism 582 to protect the first and second linear actuators 584, 586 from damage and wear.

It will thus be understood that extension of the first linear actuator 584 and retraction of the second linear actuator 586 steers the gearcase in a first direction, for example in the port direction. Conversely, extension of the second linear actuator 586 and retraction of the first linear actuator 584 steers the gearcase in an opposite, second direction, for example in the starboard direction. It should also be understood that while the illustrated embodiment has first and second linear actuators 584, 586, in other examples the steering mechanism 582 could include only one of the first and second linear actuators 584, 586. While such an arrangement may be less powerful it would be suitable for causing the above-described steering movements, at least in certain applications.

Figure 22:
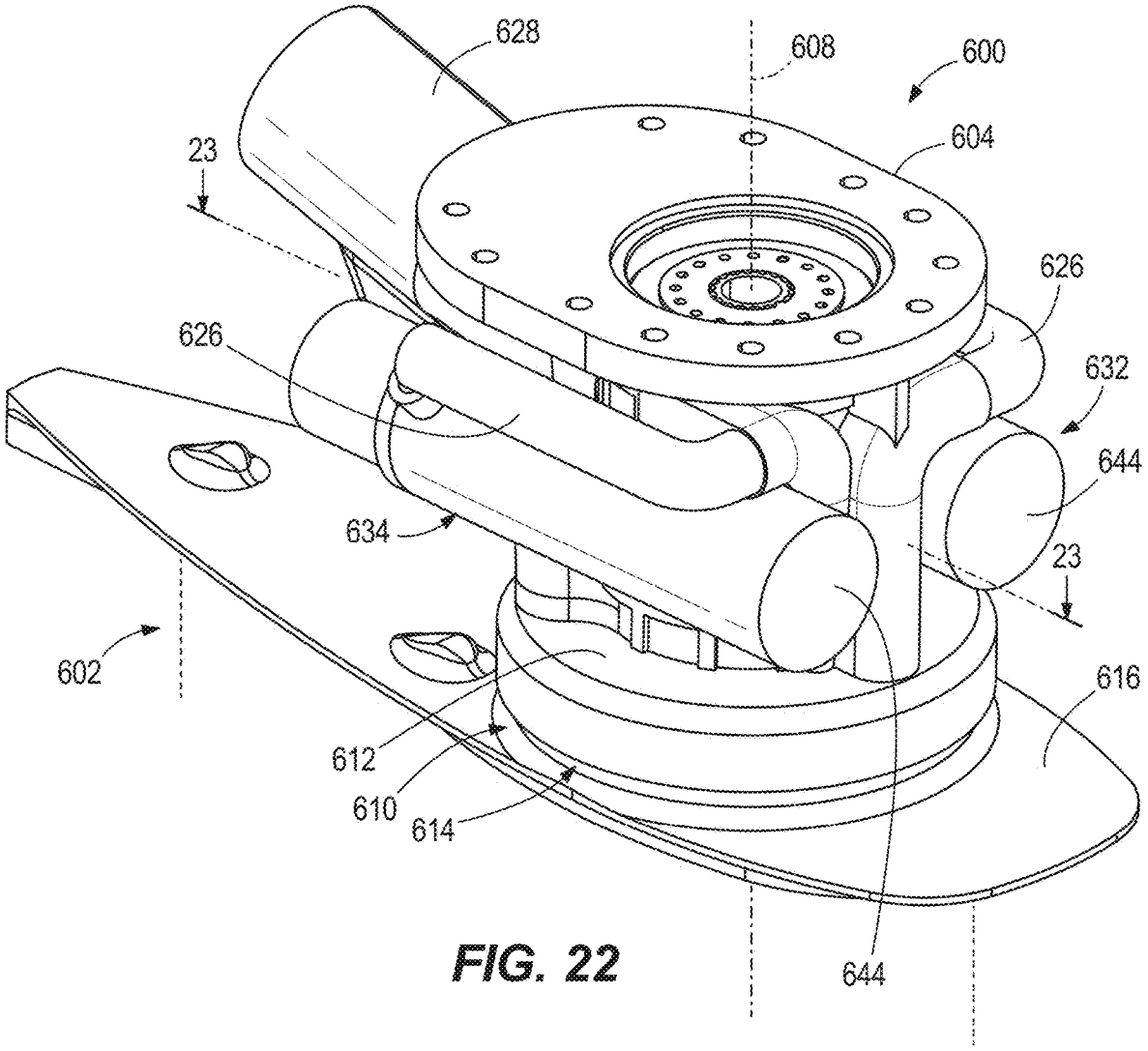
FIG. 22 is a perspective view of a fifth embodiment of a steering housing and lower gearcase according to the present disclosure.
Figure 23:
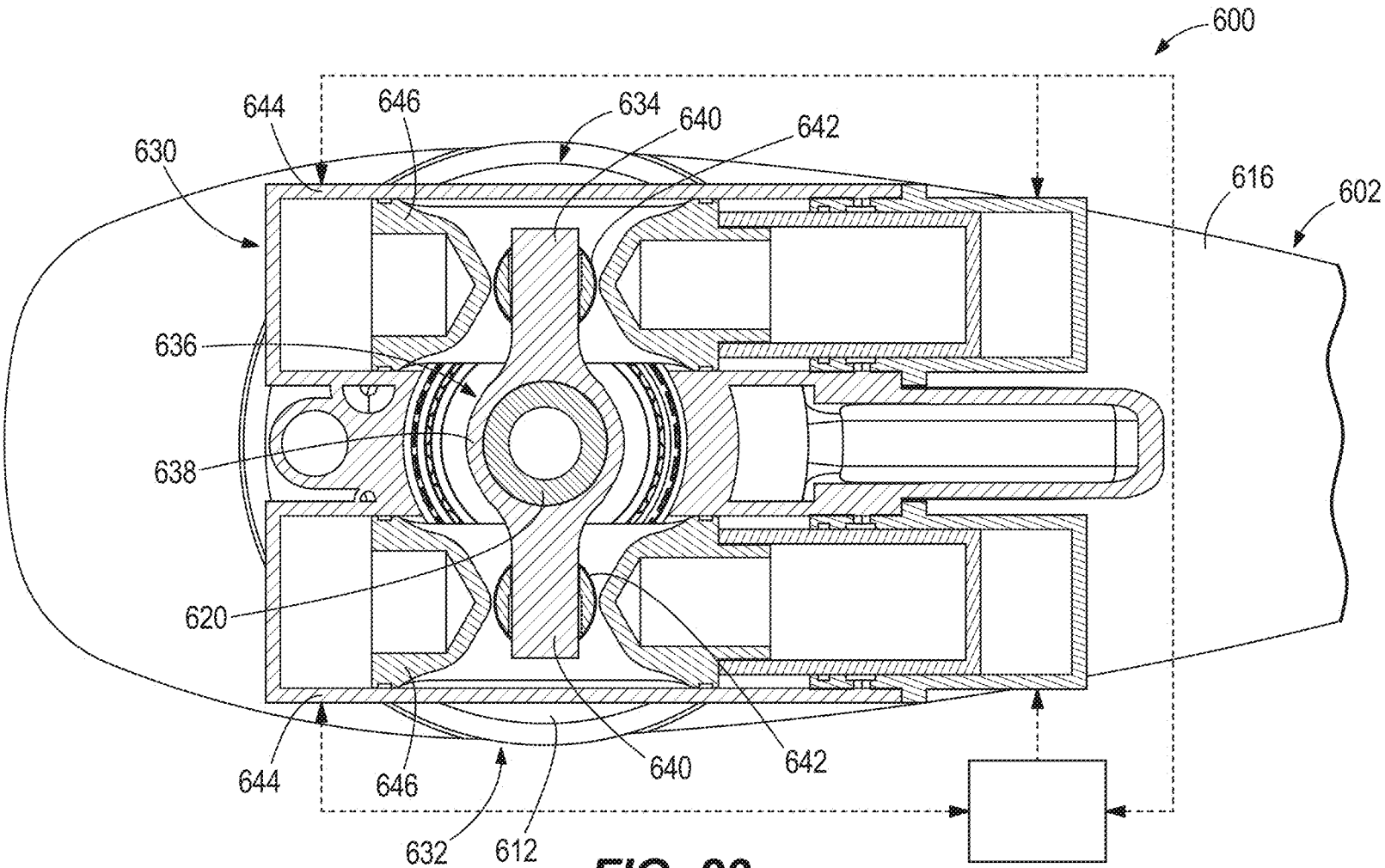
FIG. 23 is a view of Section 23-23, taken in FIG. 22.
Figure 24:
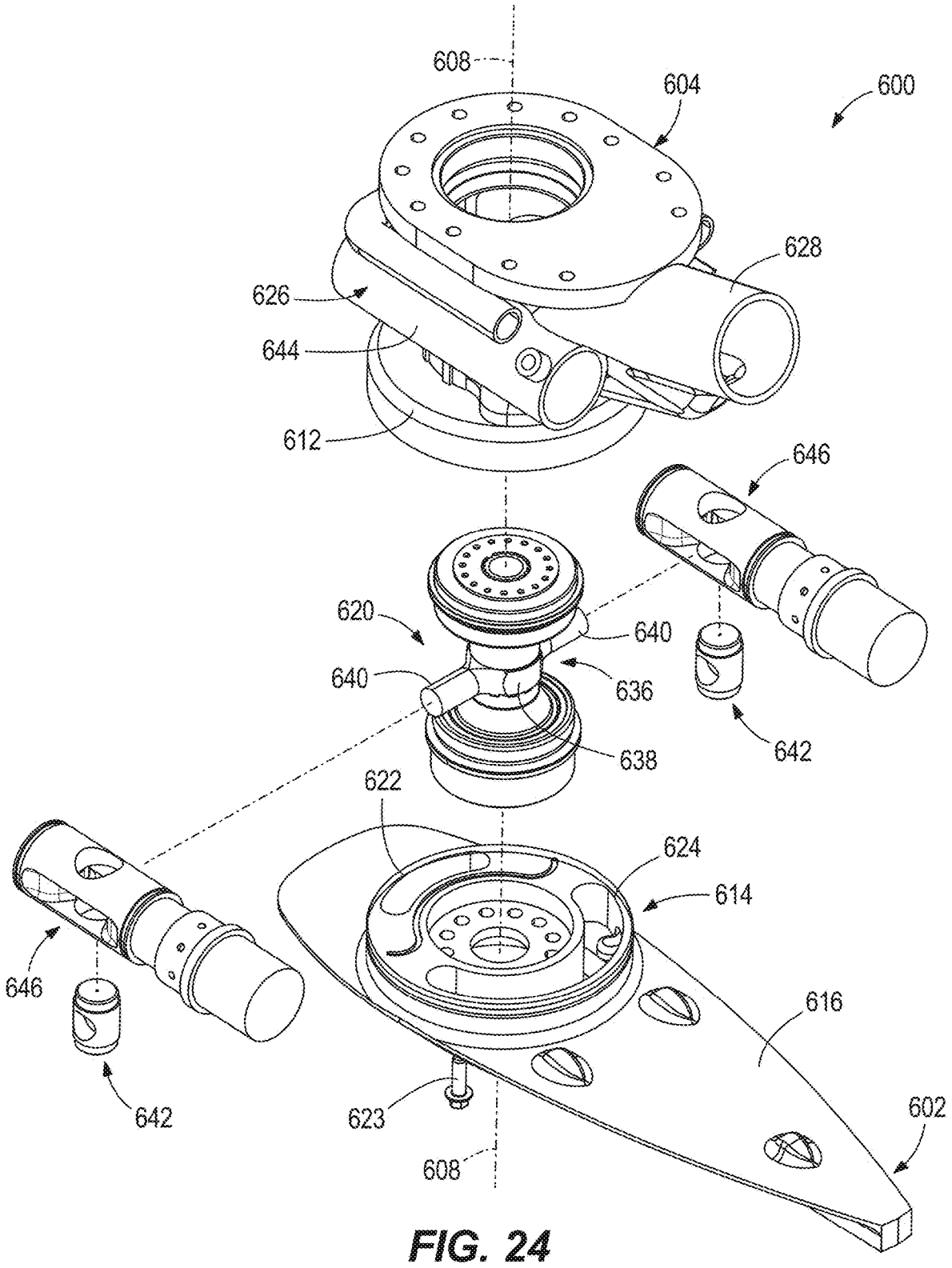
FIG. 24 is an exploded view of the embodiment in FIG. 22.

FIGS. 22-24 depict portions of a fifth embodiment of a marine drive 600, which for example can be an outboard motor, stern drive, and/or the like. Although not shown in FIGS. 22-24, and just like the first and second embodiments described herein above, the marine drive 600 has a powerhead which causes rotation of a driveshaft, which in turn causes rotation of a propulsor for propelling the marine drive 600 in a body of water. As shown in FIGS. 22-24, the marine drive 600 has a gearcase 602 configured to support the propulsor. A steering housing 604 is located between the noted powerhead and the gearcase 602 and, as described herein above regarding the first and second embodiments, a driveshaft or an extension thereof extends through the steering housing 604 and is operatively coupled to the propulsor in the gearcase 602.

The gearcase 602 is steerable relative to the steering housing 604 about a steering axis 608 which is coaxial with the noted driveshaft. The gearcase 602 and steering housing 604 are connected at a steering joint 610. The steering joint 610 has an annular flange 612 on the steering housing 604 which slides over an annular pedestal 614 that extends upwardly from the gearcase cover 616. A steering column 620 is fixedly mounted by fasteners 623 to the gearcase cover 616, at the center of the annular pedestal 614.

Like the embodiments described herein above, the steering joint 610 is configured to facilitate pumping of cooling water and exhaust from the gearcase 602 to the powerhead, in particular having widened cooling water and exhaust channels 622, 624 formed through the annular pedestal 614 and corresponding cooling water and exhaust passages 626, 628 formed through the steering housing 604. Upper and lower annular bearings and seals, some of which are not shown, are also provided in accordance with the previously described embodiments. Continuous communication between the widened channels 622, 624 and passages 626, 628, throughout the below-described steering movement of the gearcase 602, is also provided in accordance with the various configurations previously described herein above.

Referring to FIGS. 23-24, the fifth embodiment of the marine drive 600 has a novel steering mechanism 630 for steering the gearcase 602 relative to the steering housing 604. This embodiment is most like the second embodiment described hereinabove with reference to FIGS. 7-9, however, instead of having a single yoke-and-trunnion device for enacting steering movements, the marine drive 600 has dual, diametrically opposed yoke-and-trunnion devices 632, 634 that work together to cause steering movement of the gearcase 602 relative to the steering housing 604. In particular, the steering mechanism 630 has a yoke 636 with a body 638 that is integral with or fixed to the steering column 620 by for example an axially splined coupling, such that the yoke 636 remains rotatably fixed relative to the steering column 620 and gearcase 602 during steering movements thereof. The yoke 636 has diametrically opposing arms 640 that radially extend from the body 638. Both arms 640 extends into sliding engagement with a bore in a respective rotatable trunnion cylinder 642 contained in a respective cylinder 644 mounted on or integral with the steering housing 604. The trunnion cylinders 642 are integrated with pistons 646 in the cylinders 644 such that the cylinders are rotatable about their own axis and relative to the respective piston 646. The pistons 646 are reciprocal (i.e., they slide back and forth) within the cylinders 644 under force of hydraulic fluid applied to either side of the pistons 646 by a conventional hydraulic pump 648 and associated valves (not shown), like the second embodiment described herein above with reference to FIGS. 7-9.

The pistons 646 are caused by the hydraulic pump 648 to reciprocate oppositely relative to each other during turning movements. Varying the hydraulic pressures on opposite sides of the pistons 646, relative to each other, causes the pistons 646 to slide within the cylinders 644, which moves the trunnion cylinders 642 and forces the arms 640 to rotate about the steering axis 608. During axial movement of the pistons 646, the trunnion cylinders 642 are caused to move axially and rotate about their own axis due to engagement between the arms 640 and the bores in the trunnion cylinders 642, which causes the yoke 636 to rotate about the steering axis 608. The arms 640 are free to slide into or out of the respective bores depending upon the direction of movement of the pistons 646. The yoke 636 is rotatably fixed to the steering column 620 such rotation of the arms 640 causes rotation of the steering column 620 and gearcase 602 relative to the steering housing 604. It will thus be understood that steering movements of the gearcase 602 can be controlled via operation of the hydraulic pump 648 to change the hydraulic pressure applied to either side of the respective pistons 646.

Figure 25:
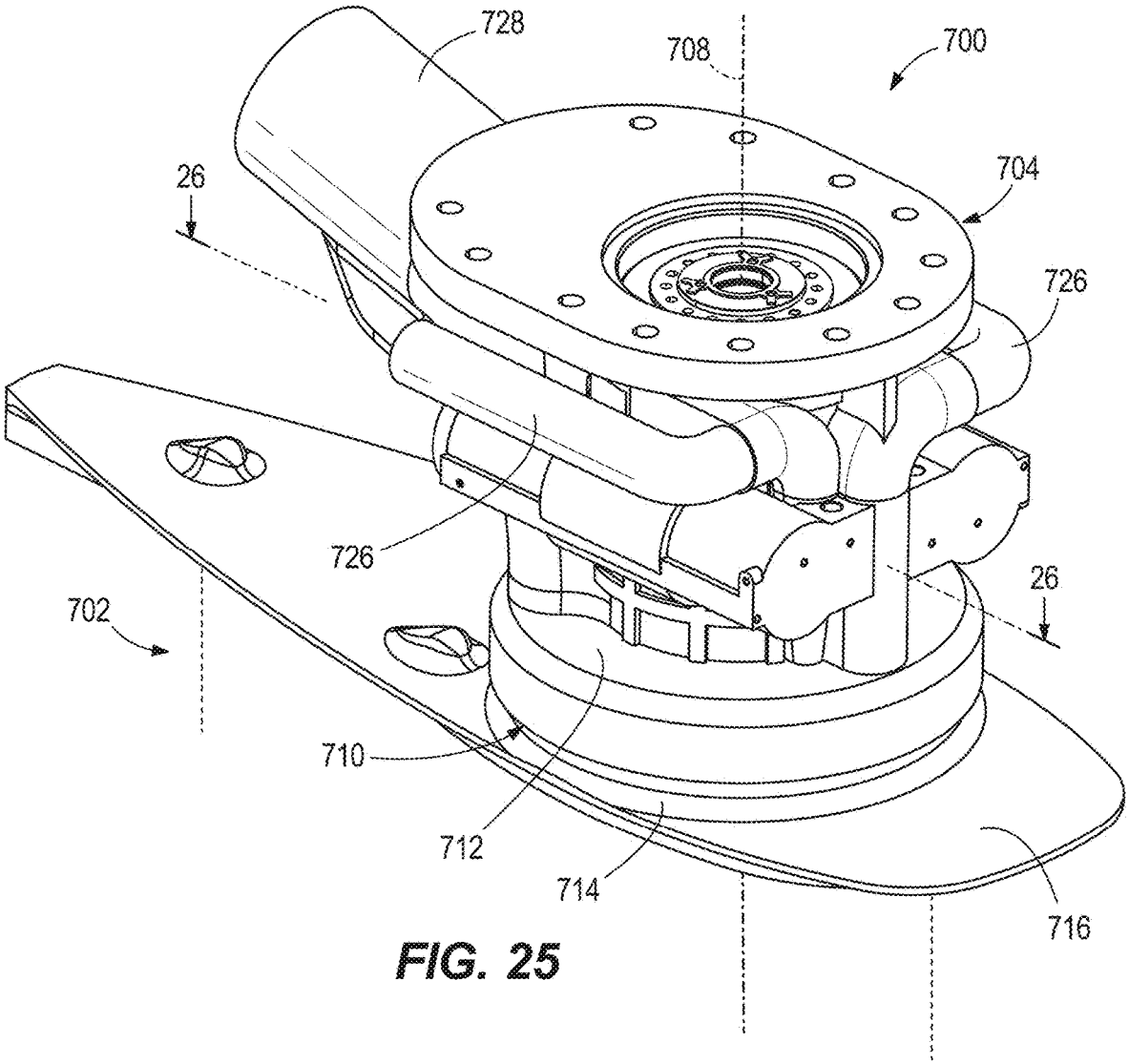
FIG. 25 is a perspective view of a sixth embodiment of a steering housing and lower gearcase according to the present disclosure.
Figure 26:
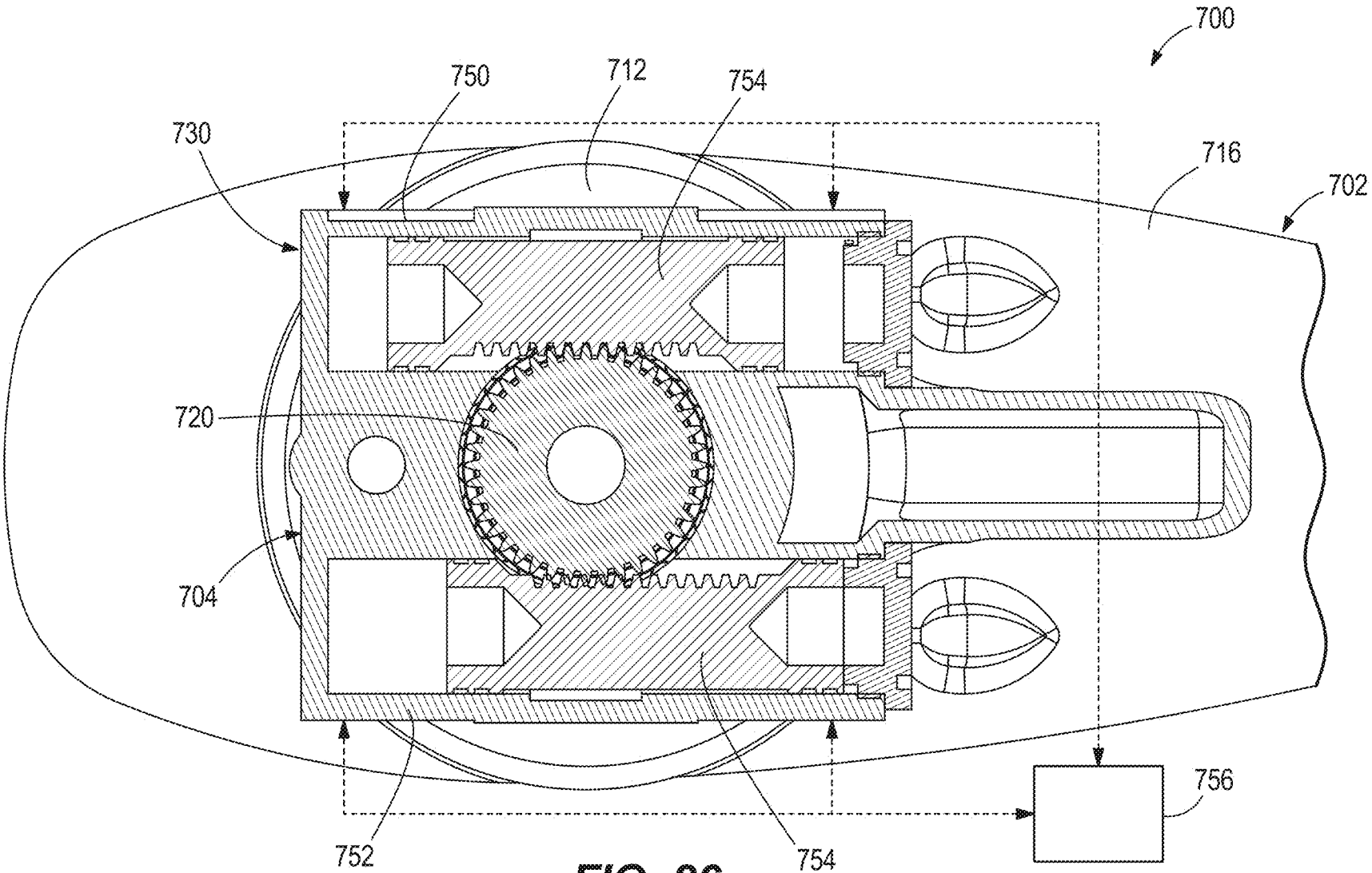
FIG. 26 is a view of Section 26-26, taken in FIG. 25.
Figure 27:
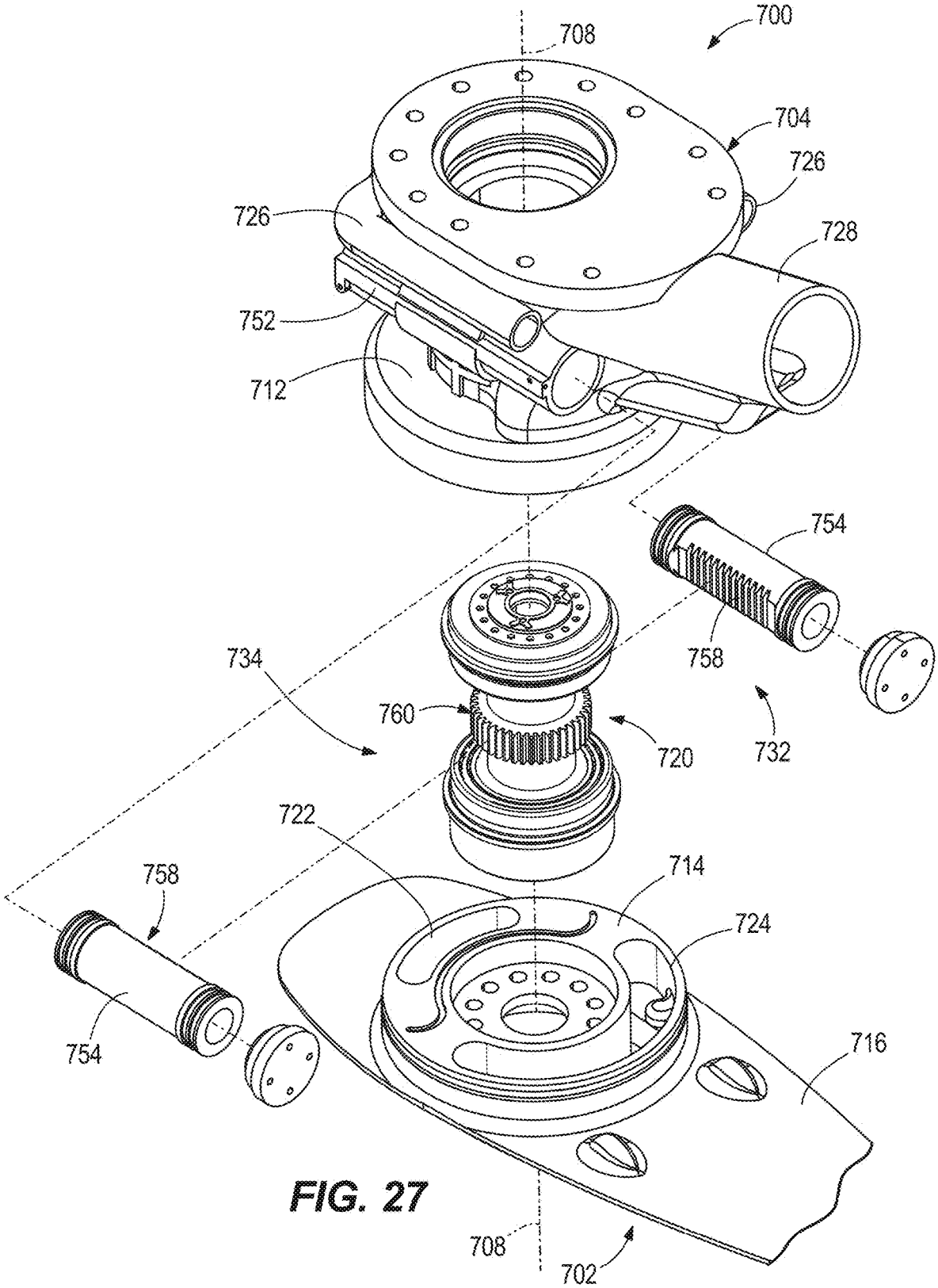
FIG. 27 is an exploded view of the embodiment shown in FIG. 25.

FIGS. 25-27 depict portions of a sixth embodiment of a marine drive 700, which for example can be an outboard motor, stern drive, and/or the like. Although not shown in FIGS. 27-21, and just like the first and second embodiments described herein above, the marine drive 700 has a powerhead which causes rotation of a driveshaft, which in turn causes rotation of the noted propulsor. As shown in FIGS. 25-27, the marine drive 700 has a gearcase 702 configured to support the propulsor. A steering housing 704 is located between the noted powerhead and the gearcase 702. As described herein above regarding the first and second embodiments, a driveshaft or an extension thereof extends through the steering housing 704 and is operatively coupled to the propulsor in the gearcase 702.

In particular, and most like the first embodiment, the gearcase 702 is steerable relative to the steering housing 704 about a steering axis 708 which is coaxial with the noted driveshaft. The gearcase 702 and steering housing 704 are connected at a steering joint 710. The steering joint 710 has an annular flange 712 on the steering housing 704 which slides over an annular pedestal 714 on the gearcase cover 716. A steering column 720 is fixedly mounted to the gearcase cover 716, in a recess at the center of the annular pedestal 714.

Like the embodiments described herein above, the steering joint 710 is configured to facilitate conveyance of cooling water and exhaust from the gearcase 702 to the powerhead. The steering joint 710 includes widened cooling water and exhaust passages 722, 724 formed through the annular pedestal 714 and a corresponding cooling water and exhaust passages 726, 728 formed through the steering housing 704. Upper and lower annular bearings and seals are also provided in accordance with the previously described embodiments. Continuous communication between the widened cooling water and exhaust channels 722, 724 and passages 726, 728, during and throughout steering movement of the gearcase 702 is achieved in accordance with the various configurations previously described.

The marine drive 700 has a novel steering mechanism 730 for steering the gearcase 702 relative to the steering housing 704. This embodiment is similar to the first embodiment described hereinabove with reference to FIGS. 3-6, however, instead of having a single rack-and-pinion device for enacting the steering movements, the marine drive 700 has dual, diametrically opposed rack-and-pinion devices 732, 734 that work together to cause steering movement of the gearcase 702 relative to the steering housing 704.

In particular, the steering mechanism 730 has opposed cylinders 750, 752 located on opposite sides of the steering housing 704. A piston 754 is in each of the opposed cylinders 750, 752. Each piston 754 is movable back and forth within the respective cylinder 750, 752 under force of hydraulic fluid provided by a conventional hydraulic pump 756, just like the first embodiment described herein above with reference to FIGS. 3-6. Application of hydraulic pressure on opposite respective sides of the pistons 754 slides the pistons in opposite directions. Each piston 754 is engaged with the steering column 720 (on opposite sides of the steering column 720, respectively) via a rack-and-pinion such that back-and-forth movement of the pistons 754 causes rotation of the steering column 720 and the gearcase 702 about the steering axis 708 with respect to the steering housing 704. Each rack and pinion comprises a set of teeth 758 on the piston 754 that is meshed with a ring of teeth 760 on the steering column 720 such that back and forth linear movement of the set of teeth 760 on the piston 754 causes back and forth rotational movement of the ring of teeth 760 on the steering column 720 about the steering axis 708.

It will thus be understood that steering movements of the gearcase 702 can be controlled via operation of the hydraulic pump 756 to change the hydraulic pressure applied to either side of the respective pistons 754. The pistons 754 are reciprocated oppositely relative to each other during turning movements. Change the pressures in the cylinders 750, 752, as described above, causes the pistons 754 to slide oppositely relative to each other within the cylinders 750, 752, which turns the steering column 720 about the steering axis 708 via the rack and pinion connections.

In the present description, certain terms have been used for brevity, clarity and understanding. No unnecessary limitations are to be inferred therefrom beyond the requirement of the prior art because such terms are used for descriptive purposes only and are intended to be broadly construed.

We claim:

1. A marine drive comprising:

a powerhead that causes rotation of a driveshaft;

a gearcase that supports a propulsor for propelling the marine drive in a body of water; and a steering housing disposed between the powerhead and the gearcase, wherein the driveshaft or an extension thereof extends through the steering housing is operatively coupled to the propulsor;

wherein the gearcase is steerable about a steering axis relative to the steering housing, and wherein the gearcase and steering housing are connected at a steering joint through which cooling water from the body of water is conveyed to the powerhead throughout steering movement of the gearcase and through which exhaust from the powerhead is conveyed to the body of water throughout steering movement of the gearcase.

2. The marine drive according to claim 1, further comprising a cooling water passage in the steering housing and an oblong, widened cooling water channel in the gearcase, wherein the cooling water passage has an inlet end that faces and receives cooling water from the widened cooling water channel throughout steering movement of the gearcase relative to the steering housing.

3. The marine drive according to claim 1, further comprising an exhaust passage in the steering housing and an oblong, widened exhaust channel in the gearcase, wherein the exhaust passage has an outlet end that faces and discharges exhaust to the widened exhaust channel throughout steering movement of the gearcase relative to the steering housing.

4. The marine drive according to claim 1, further comprising a worm drive configured to steer the gearcase about the steering axis.

5. A marine drive comprising:

a powerhead that causes rotation of a driveshaft;

a gearcase that supports a propulsor for propelling the marine drive in a body of water;

a steering housing disposed between the powerhead and the gearcase, wherein the driveshaft or an extension thereof extends through the steering housing is operatively coupled to the propulsor; and a worm drive configured to steer the gearcase about a steering axis relative to the steering housing, wherein the gearcase and steering housing are connected at a steering joint through which at least one of cooling water from the body of water is conveyed to the powerhead throughout steering movement of the gearcase and exhaust from the powerhead is conveyed to the body of water throughout steering movement of the gearcase, and wherein the steering joint comprises an annular bearing and further wherein the worm drive is coupled to the annular bearing such that operation of the worm drive in a first direction steers the gearcase in a port direction and such that operation of the worm drive in an opposite, second direction steers the gearcase in a starboard direction.

6. The marine drive according to claim 5, wherein the annular bearing comprises an inner bearing race that remains fixed relative to the steering housing and an outer bearing race that remains fixed relative to the gearcase.

7. The marine drive according to claim 5, further comprising a cover on the annular bearing and coupled to the steering housing, wherein the worm drive is on the cover.

8. The marine drive according to claim 1, further comprising a linear actuator configured to steer the gearcase about the steering axis.

9. The marine drive according to claim 8, wherein extension of the linear actuator steers the gearcase in a first direction and wherein retraction of the linear actuator steers the gearcase in an opposite, second direction.

10. The marine drive according to claim 9, wherein the linear actuator is a first linear actuator and further comprising a second linear actuator, wherein extension of the first linear actuator and retraction of the second linear actuator steers the gearcase in the first direction and wherein retraction of the first linear actuator and extension of the second linear actuator steers the gearcase in the opposite, second direction.

11. The marine drive according to claim 10, wherein the first and second linear actuators are disposed on opposite sides of the steering axis, respectively.

12. The marine drive according to claim 11, wherein the first and second linear actuators each have a first end that is pivotably coupled to the gearcase and a second end that is pivotably coupled to the steering housing.

13. The marine drive according to claim 1, further comprising a steering column fixed to the gearcase and extending into the steering housing.

14. The marine drive according to claim 13, further comprising a piston that is movable back and forth in a cylinder to steer the gearcase about the steering axis, and further wherein the piston is engaged with the steering column via a yoke and a trunnion such that back-and-forth movement of the piston causes rotation of the steering column and the gearcase about the steering axis.

15. The marine drive according to claim 14, wherein the yoke comprises a yoke body that is rotatably fixed to the steering column and a yoke arm that extends from the yoke body into engagement with the trunnion such that back-and-forth linear movement of the piston causes back and forth rotational movement of the yoke and the steering column about the steering axis.

16. The marine drive according to claim 15, wherein the yoke arm is a first yoke arm and further comprising a second yoke arm extending from an opposite side of the yoke body, and wherein the piston and trunnion are a first piston and a first trunnion, and further comprising a second piston and a second trunnion disposed on the opposite side of the yoke body, and further wherein the second yoke arm extends from the yoke body into engagement with the second trunnion such that pack and forth linear movement of the piston causes back and forth rotational movement of the yoke and the steering column about the steering axis.

17. The marine drive according to claim 13, further comprising a piston that is movable back and forth in a cylinder to steer the gearcase about the steering axis, and further wherein the piston is engaged with the steering column via a rack and pinion such that back and forth movement of the piston causes rotation of the steering column and the gearcase about the steering axis.

18. The marine drive according to claim 17, wherein the rack and pinion comprises a set of teeth on the piston that are meshed with a ring of teeth on the steering column such that back and forth linear movement of the piston causes back and forth rotational movement of the steering column about the steering axis.

19. The marine drive according to claim 18, wherein the piston is a first piston and further comprising a second piston disposed on an opposite side of the steering column, and wherein the rack and pinion is a first rack and pinion, and wherein the second piston is engaged with the steering column via a second rack and pinion such that back and forth movement of the piston causes rotation of the steering column and the gearcase about the steering axis.

20. The marine drive according to claim 1, wherein the marine drive comprises an outboard motor.

* * * * *